US007987533B2

(12) United States Patent
Phipps et al.

(10) Patent No.: US 7,987,533 B2
(45) Date of Patent: Aug. 2, 2011

(54) SHOWER WATER TOY CONSTRUCTION SYSTEM

(75) Inventors: James D. Phipps, Montclair, VA (US); Lori A. Phipps, Montclair, VA (US); Travis Lontz, Woodford, VA (US); Brian Spaeth, Fredericksburg, VA (US)

(73) Assignee: Aquastruct, Inc., Montclair, VA (US)

( * ) Notice: Subject to any disclaimer, the term of this patent is extended or adjusted under 35 U.S.C. 154(b) by 589 days.

(21) Appl. No.: 11/823,012

(22) Filed: Jun. 26, 2007

(65) Prior Publication Data

US 2009/0000022 A1 Jan. 1, 2009

(51) Int. Cl.
*A47K 3/022* (2006.01)

(52) U.S. Cl. ..... 4/601; 4/596; 4/597

(58) Field of Classification Search ..... 4/596–618
See application file for complete search history.

(56) References Cited

U.S. PATENT DOCUMENTS

| | | | | | |
|---|---|---|---|---|---|
| 439,793 | A * | 11/1890 | Taylor | 4/601 |
| 585,439 | A * | 6/1897 | Hooper | 4/601 |
| 3,752,472 | A * | 8/1973 | Snead | 482/35 |
| 4,242,201 | A * | 12/1980 | Stephens et al. | 4/615 |
| 4,741,289 | A * | 5/1988 | Blose | 4/567 |
| 4,834,121 | A * | 5/1989 | Bell | 4/516 |
| 5,154,671 | A * | 10/1992 | Smollar et al. | 472/117 |
| 5,385,472 | A * | 1/1995 | Mullin | 434/126 |
| 5,401,214 | A * | 3/1995 | Smollar et al. | 472/117 |
| 5,480,336 | A * | 1/1996 | Blanchard | 239/279 |
| 5,634,890 | A * | 6/1997 | Morris | 601/166 |
| 5,774,907 | A * | 7/1998 | Doggwiler | 4/606 |
| 6,237,860 | B1 * | 5/2001 | Ducey | 239/266 |
| 6,561,810 | B1 * | 5/2003 | Schellhardt et al. | 434/126 |
| 6,745,414 | B2 * | 6/2004 | Zhou | 4/601 |
| 2004/0217196 | A1 * | 11/2004 | Yurek et al. | 239/289 |
| 2005/0127211 | A1 * | 6/2005 | Yeiser | 239/587.1 |
| 2007/0264075 | A1 * | 11/2007 | Panasci et al. | 401/289 |

* cited by examiner

*Primary Examiner* — Khoa D Huynh

(74) *Attorney, Agent, or Firm* — Hudak, Shunk & Farine Co. LPA

(57) ABSTRACT

A shower water construction system for a child/user, which also functions as a showering system and utilizes a pre-existing bath/shower unit as a supporting structure. The construction system comprises a main control valve to divert water from a pre-existing shower water pipe stem, a pressure regulator to limit water pressure to downstream components, child/user control and diverter valves to allow for turning the system off and on and allocating water flow between components, semi-rigid and flexible pipe, "Y" connectors and suction cups and brackets. Other components, such as a hand-held sprayer, spraying bathtub mat and spraying shower curtain may also be integrated/connected into the system.

4 Claims, 26 Drawing Sheets

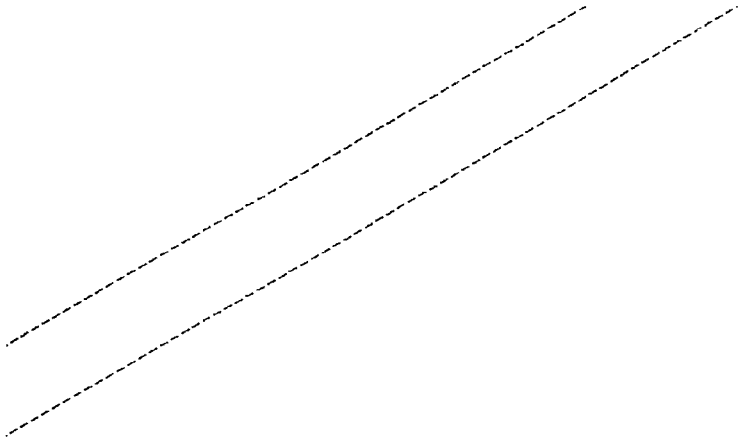
FIG. 2
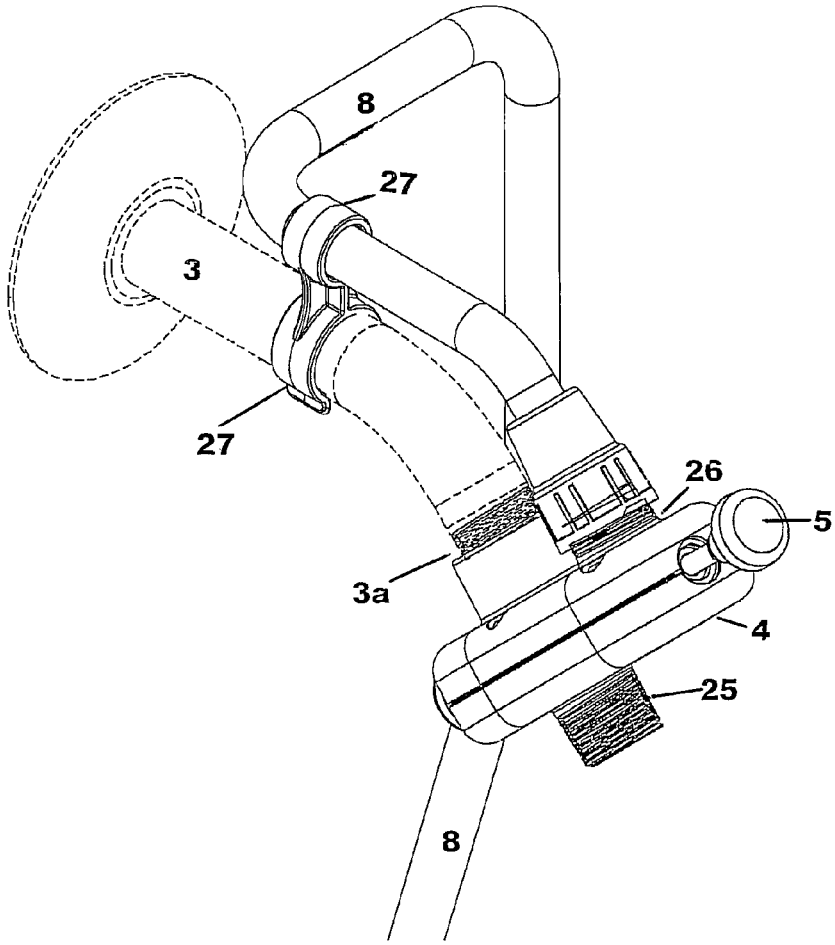

SHOWER WATER TOY CONSTRUCTION SYSTEM

FIELD OF THE INVENTION

This invention relates to water construction components and toys, which provide entertainment to users and also function as a shower system. More particularly, this invention relates to a water construction system, suitable for indoor use, which utilizes pressure driven water (from an existing shower water pipe stem) diverted to the system's water delivery components that rely upon the pressure-driven water for their function. The components are connected to each other and mounted to the shower/bath wall.

BACKGROUND OF THE INVENTION

Water play structures are known in the art, as are water construction toys. U.S. Pat. Nos. 5,820,472 and 5,649,867 are directed to portable water play structures which are assembled for outdoor, backyard play. These water structures are comprised of a plurality of conduit members and connectors adapted to be connected together to form a free standing frame. Water is provided through an ordinary garden hose.

A similar water toy construction kit is illustrated in U.S. Pat. No. 5,480,336, which includes a plurality of tube elements and mating connectors, with an adapter to connect the structure to a garden hose.

U.S. Pat. No. 5,385,472 relates to a water construction toy for mounting on a vertical surface. The toy relies on the force of gravity to flow water from a central reservoir component through various fluid-conveying and operated toys. The reservoir must be kept filled for the toy parts to function. While perhaps entertaining, the toy does not facilitate indoor showering, even if used on a conventional, vertical shower/bathtub wall, because there is no pressure driven water stream and no components which function as showering devices. Moreover, while the patent provides an illustration of an embodiment of the device with a garden hose attached, presumably for outside play, the toy still relies upon filling of the reservoir and the force of gravity to flow water from the reservoir to the toy components. Thus, this outdoor embodiment does not facilitate indoor showering use.

The shower water toy construction system of the invention is useful both as an entertaining water construction toy for a child and as a means to facilitate indoor showering in any age user. The water toy construction system of the invention is unique in that it: (1) utilizes pressure driven water from a shower head, which is directed through a system of components that may be added to and removed from the system through various interconnecting means, (2) allows for parental control of the amount of water used, and (3) limits the water supply to a flow rate of 2.5 gallons per minute. In addition, a pressure regulator, built into the system, limits the water pressure to downstream water delivery components to no greater than about 35 psi.

The construction system comprises a number of downstream water delivery components, including but not limited to shutoff (on/off) valves, diverter valves, semi-rigid and flexible pipe water conduits, spraying pipes, spraying shower curtain and bath tub mat, end sprayer, and other spraying or water delivery devices. Generally, downstream water delivery components can be connected into the system in any order that is consistent with their end configurations (male/female) and that facilitates the directional flow of water further downstream to other components. As is expected with a "construction" device, some assembly is needed to connect the system to the pre-existing shower water pipe stem and to connect the components to each other and the shower/bath walls.

The construction components of the instant invention offer significant advantages in control of water flow, ease of assembly, disassembly and use, indoor use, and facilitation of shower functions, as compared to other water construction toys previously known.

It is an object of the invention to provide a shower water toy construction system that is educational, entertaining and functional as an indoor shower system.

It is a further object of the invention to provide a method to limit water flow to the system to avoid water waste, while still providing the educational, entertainment and functional (shower) benefits of the system.

Another object of the invention is to provide an entertaining and functional water construction and shower system, which is easy and safe to use and requires minimal adult supervision when used by a child or a person with disabilities.

A further object of the invention is to provide a shower water construction system that utilizes the pre-existing shower water pipe stem for a pressurized water source and standard shower/bath walls and is easy to install.

Yet a further object of the invention is to provide a spraying device comparable to, or in the nature of, a showerhead, which can be temporarily mounted low enough on a shower wall to facilitate use by those needing to shower in a seated position (e.g., persons with certain disabilities) and after use, be returned to another position on the shower wall.

Other objects of the invention will be apparent from the description provided herein.

SUMMARY OF THE INVENTION

The invention is a novel water construction system designed for use in a pre-existing indoor shower or shower/bath unit combination, which utilizes pressure driven water from a pre-existing shower water pipe stem to operate other system components. The system comprises a means for diverting water from an existing shower water pipe stem into various other system components. The system also includes a means for controlling the water pressure to downstream water delivery components to about 35 psi, which is connected to the water diverting means. Downstream water delivery components include user control valves, such as shutoff (on/off) or diverter valves; pipes; tubing; hoses; connectors; and other water delivery components, including but not limited to spraying pipes, spraying end caps, a multi-functional sprayer, a shower head type sprayer, a spraying bathtub mat and a spraying shower curtain. Downstream water delivery components can be added to and removed from the system in any order that is consistent with their respective end configurations (male/female) and that facilitates the flow of water further downstream into other water delivery components.

The system features easy to use connect/disconnect assemblies and functional, educational, and entertaining interconnecting components, and is easily assembled with no alteration to existing shower/bath hardware and no tools.

BRIEF DESCRIPTION OF THE DRAWINGS

The invention will be better understood and other features and advantages will become apparent by reading the detailed description of the invention, taken together with the drawings, wherein:

FIG. 1(*b*) is a side view of the connection between the pressure regulator and the downstream water delivery components of the system in one exemplary arrangement.

FIG. 2 is an exploded view of the connection and relationship between the pre-existing shower water pipe stem and main control valve used in the system and located between the stem and the standard shower head (not shown).

FIG. 5(*b*) is an exploded view of a semi-rigid pipe water delivery conduit for use in the system, having spray holes or spraying function (in one possible configuration) and male configurations on both ends of the pipe.

FIG. 29 (*b*) is an exploded view of a finished/assembled "Y" connector assembly.

DETAILED DESCRIPTION OF THE INVENTION

Figure 1A:
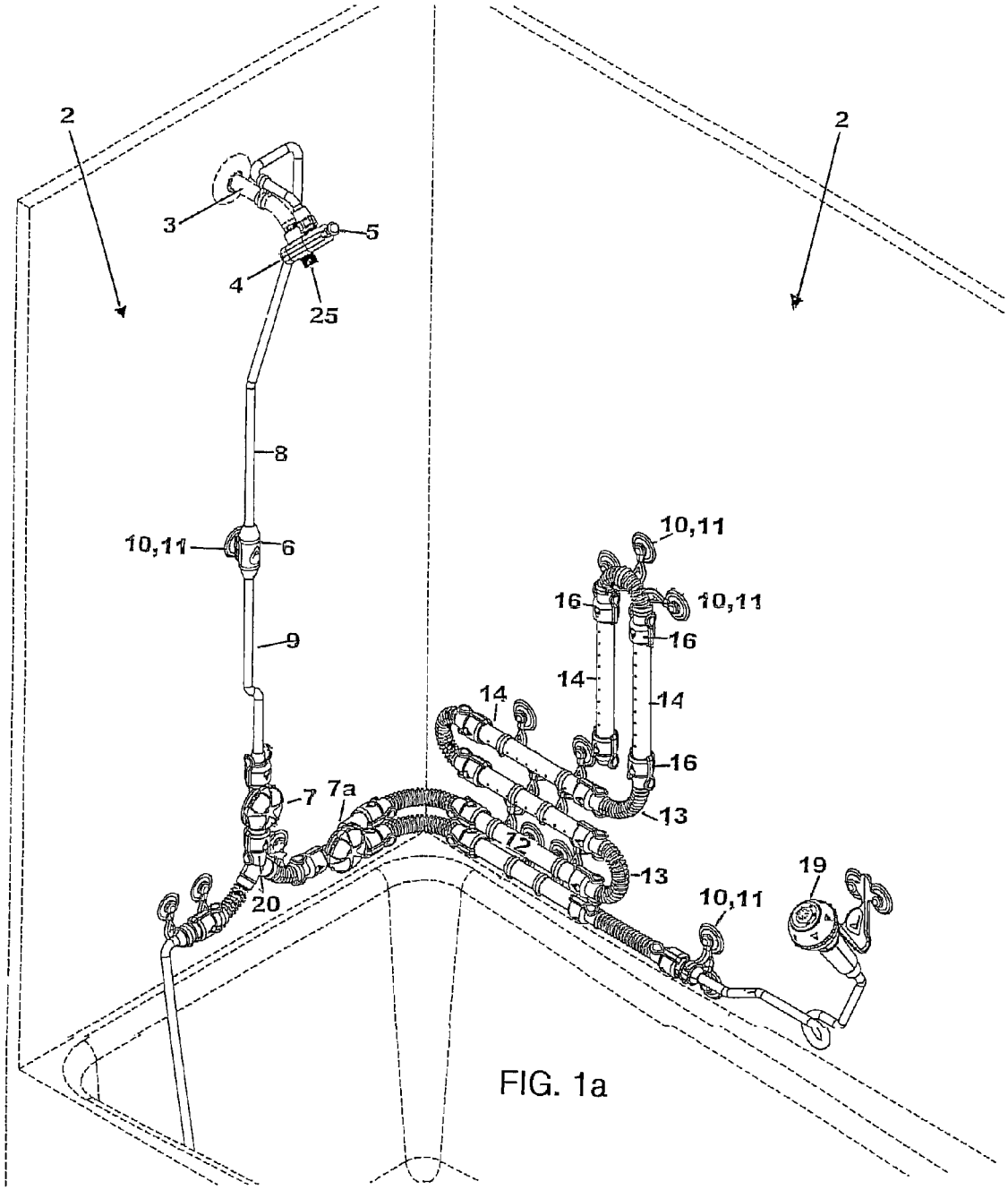
FIG. 1(*a*) is a view of the fully constructed shower water construction system showing the many components in one exemplary construction arrangement or configuration, utilizing pre-existing structures as a source of water and for support, such as a standard shower water pipe stem and a standard shower wall unit or the wall surrounding a standard bath/shower combination.
Figure 1B:
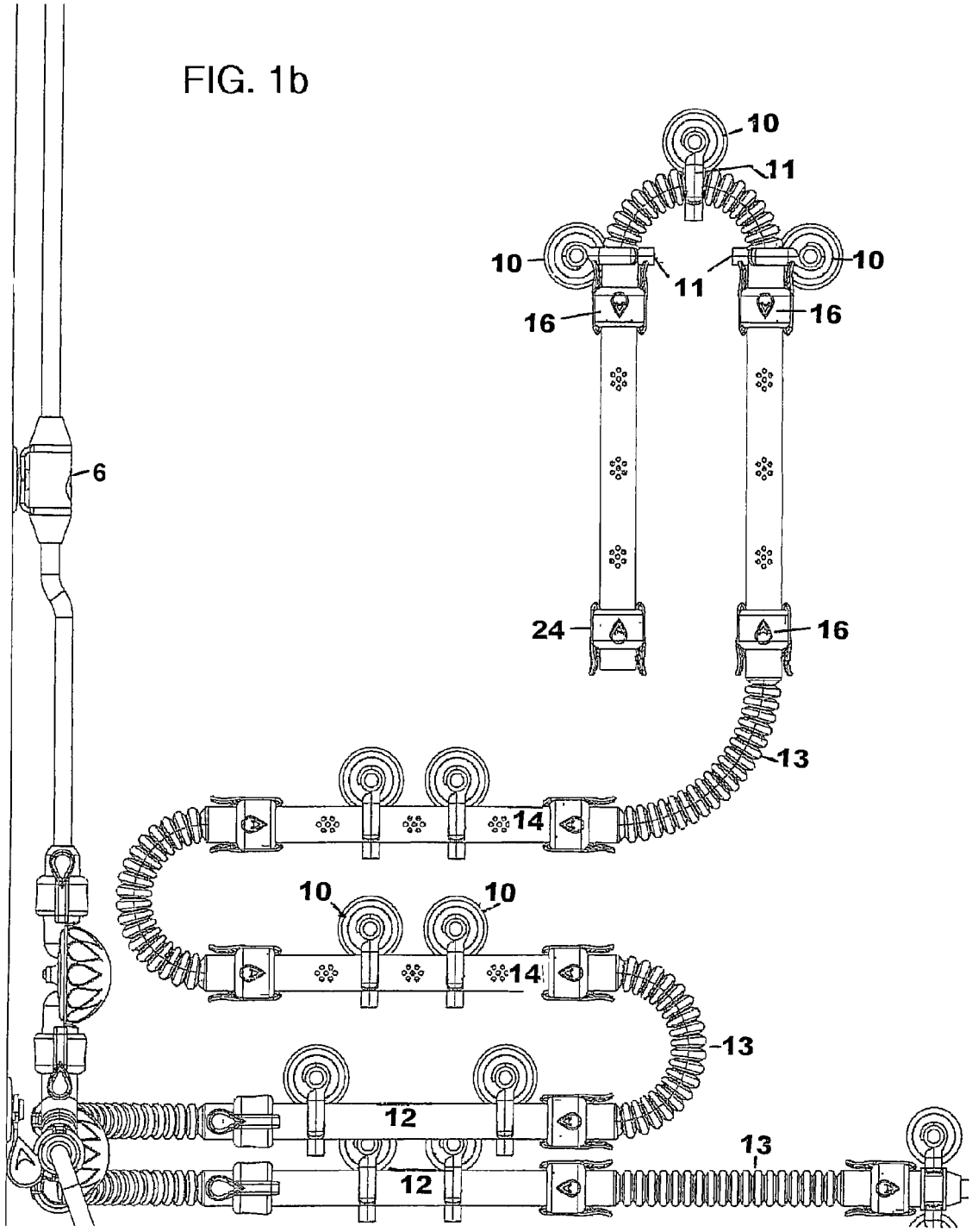

The invention is best understood by referring to the drawings. FIG. 1 illustrates one arrangement for the components of the shower water construction system (1), as a whole. In view of the ease of construction and connection, flexibility and adaptability of the system components, a variety of different arrangements and orientations may be constructed.

As FIG. 1 illustrates, the system is designed to be used within an existing shower or bath/shower wall unit (2) and has minimal impact on standard shower/bath fixtures. The system utilizes the shower water pipe stem for its source of pressure driven water. Installation of the system components onto the walls and to the water source is rapid and easy and is generally tool-free.

Figure 3:
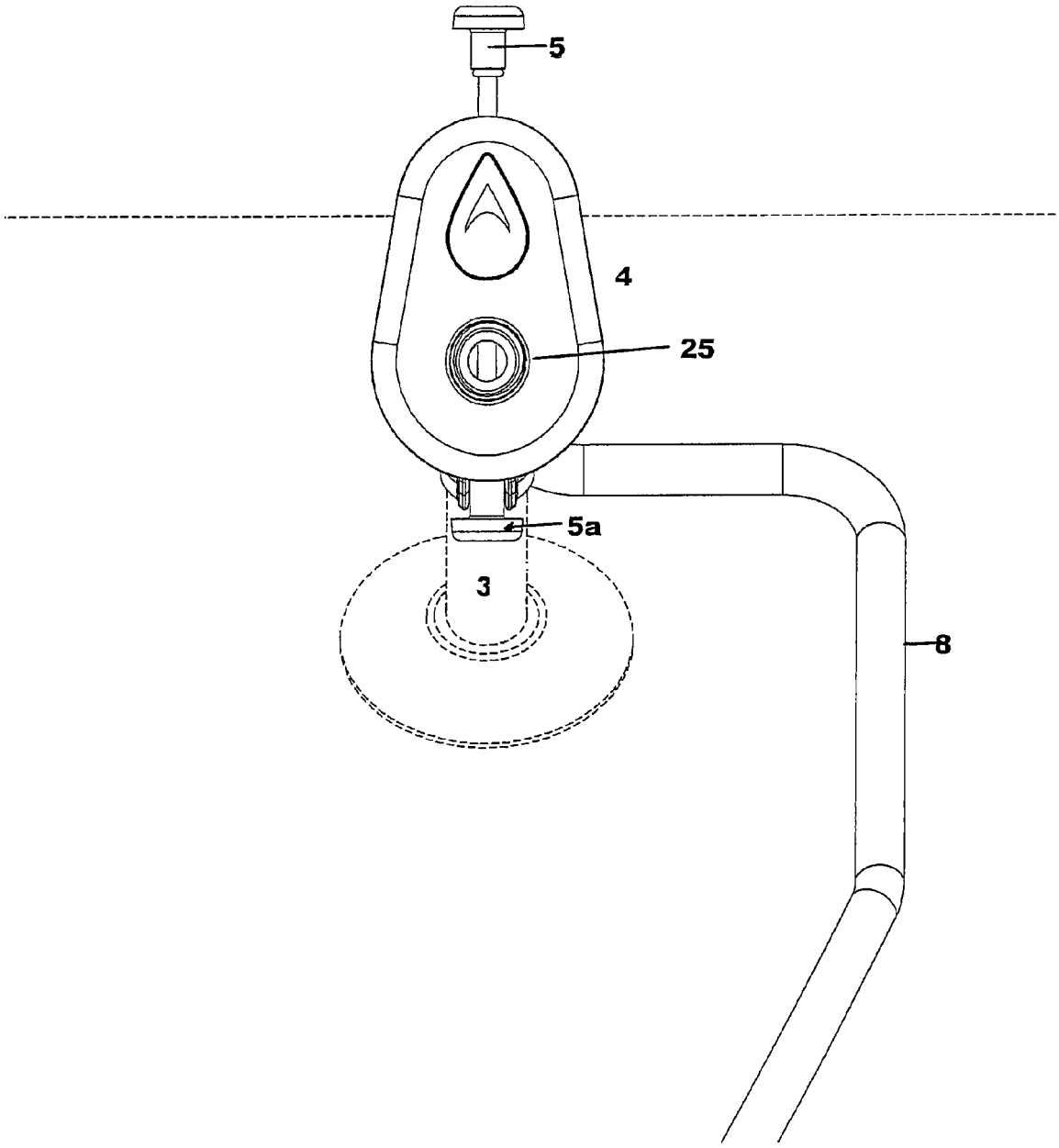
FIG. 3 is an exploded bottom view of the main (parental) control valve showing the connection to the shower water pipe stem and the high pressure drop down hose.

As illustrated in FIGS. 1, 2 and 3, the shower water toy construction system relies upon the water supply and pressure from a household shower head pipe stem (3). Water-flow control is obtained through the use of a main (parental) control valve (4), which is connected in between the existing shower water pipe stem (3) and the existing showerhead (not shown). A threaded shower water portal (25) permits attachment of the existing showerhead (not shown) to the main (parental) control valve distally, allowing a parent or other adult supervisor to control water flow to the system. (FIG. 2 (25)). FIG. 2 shows a plunger-type selector (5) on the parental control valve (4), which is used to divert flow from the existing shower head to the system.

The parental control valve (4) limits the water flow to the inventive system components to about 2.5 gallons per minute (gpm). Flow can be reduced or increased (although not beyond about 2.5 gpm) based upon the performance of the system, desire to conserve water, or both, using the pre-existing water control devices already in place with the existing shower system. The inventive system, above the pressure regulator, discussed below, can accommodate a Maximum Residential Household Pressure capability of about 125-135 psi. The invention, beneath the pressure regulator, can accommodate a Maximum Residential Household Pressure capability of about 35 psi.

As shown more clearly in FIG. 2, the main (parental) control valve (4) is the basis of the system and is connected to a standard shower head pipe (3) configuration and threading (3(*a*)). It comprises two diverting portals to allow for flow of water to either an existing shower head (25) or the inventive system (26). As such, the inventive system does not need to be removed when not in use. In particular, the selector (5) located on the valve contains an "off" feature, thus avoiding the need to remove it when an adult uses the shower, or when the inventive system is not in use. The parental control valve (4) is positioned so that it cannot be reached by an unsupervised child.

FIG. 1 illustrates one possible assembly for system components. FIG. 1 also illustrates a pressure regulator (6) connected to the parental control valve (4) by a high pressure hose (8). The pressure regulator (6) makes it possible to limit the incoming water pressure (up to about 135 psi) to 35 psi for the system's downstream water delivery components. The pressure regulator (6) comprises two connecting hoses (8, 9). The pressure regulator (6) is connected proximally to the main (parental) control valve by a high pressure hose (8) and distally to the system's downstream water delivery components by another hose (9). In one embodiment shown in FIG. 1, hose (9) connects directly to a user shutoff (on/off) valve, discussed below. Suction cups and brackets (e.g., 10, 11 of FIGS. 1 and 23) are used to mount the pressure regulator and its connecting hoses, as well as other system components, to the shower/bath wall. Useful suction cups and brackets are shown in FIGS. 24-27.

The system further includes a user shutoff (on/off) valve (7) and a user diverter valve (7*a*), which provide water control features for the child/user. The user shutoff valve (7), depending on where placed, allows the user to turn water on or off to the entire constructed system or to isolated sections of the system, and is designed to allow partial flow as well. In one embodiment (FIG. 1), the user shutoff valve (7) is connected to the main (parental) control valve via the pressure regulator (6) and its two connecting hoses (8, 9); however, it may also be employed in any area of the system downstream of the pressure regulator, as desired, for water flow control. Both the user shutoff (7) and diverter (7(*a*)) valve designs are user-friendly and provide a large rotating cover and low turning force. The user diverter valve (7(*a*)) is the same basic design as the user shutoff valve (7), but differs in that it allows the user to select between two outputs of flow or to allocate proportionately between two outputs of flow as illustrated by water flow directional lines designated as "x" and "y", of FIGS. 4 and 7. Thus, the user is able to divert flow from one water conduit outlet to another, from one component to another, and even from one separately constructed section to another, by using a selection designed into the diverter valve (7(*a*)).

The user shutoff valve (7) and user diverter valve (7(*a*)) are designed to minimize the torque necessary to operate them to as low as possible. No small parts or sharp points or edges are incorporated into the design of either valve. The valves are also designed with consideration for a child's hand ergonomics and ease of use for persons with disabilities.

Figure 5A:
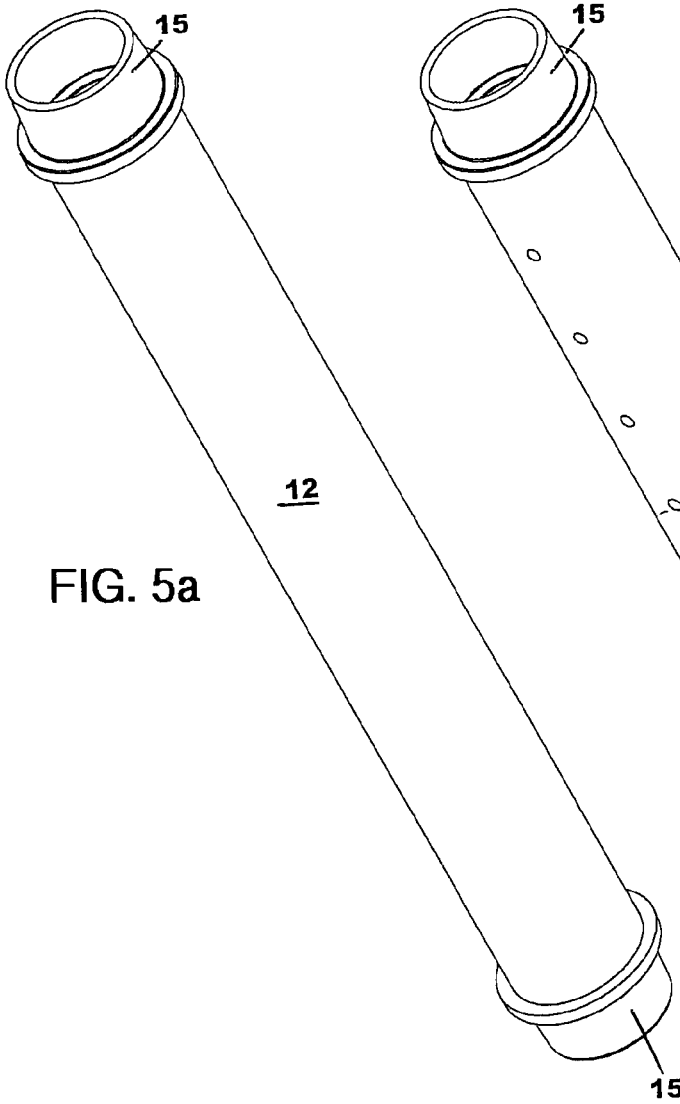
FIG. 5(*a*) is an exploded view of a semi-rigid pipe water delivery conduit for use in the system, having male configurations on both ends of the pipe.
Figure 5B:
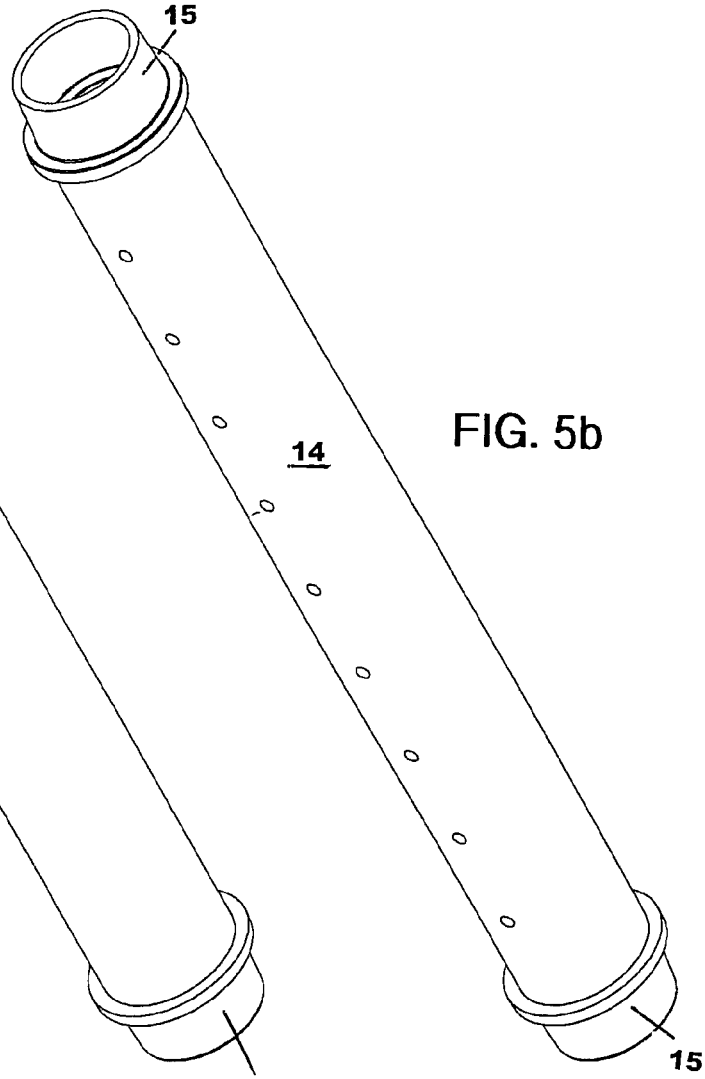
Figure 6:
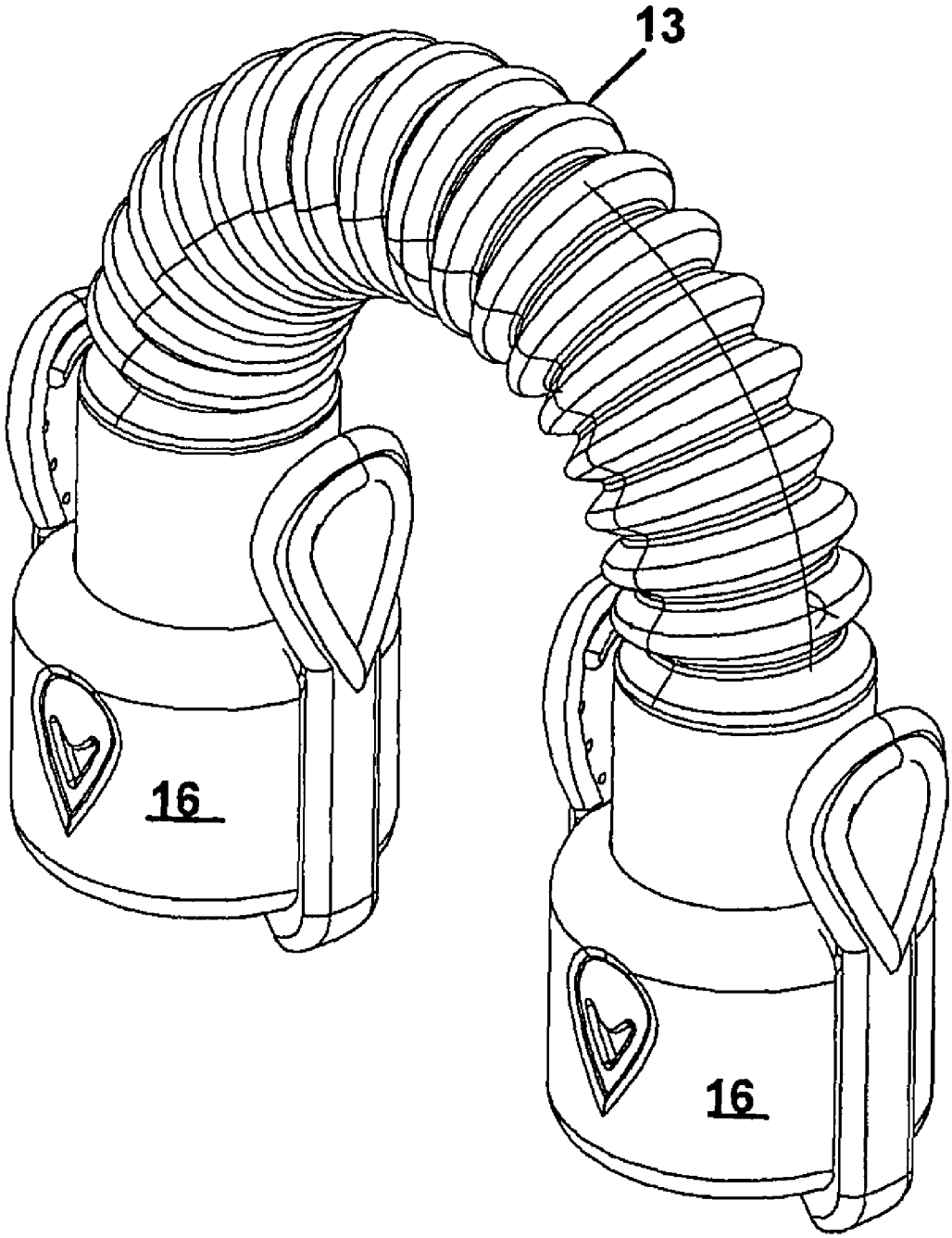
FIG. 6 is a view of the flexible pipe water delivery conduit for use in the system, having female connector assemblies (female configured ends) on both ends of the pipe.
Figure 7:
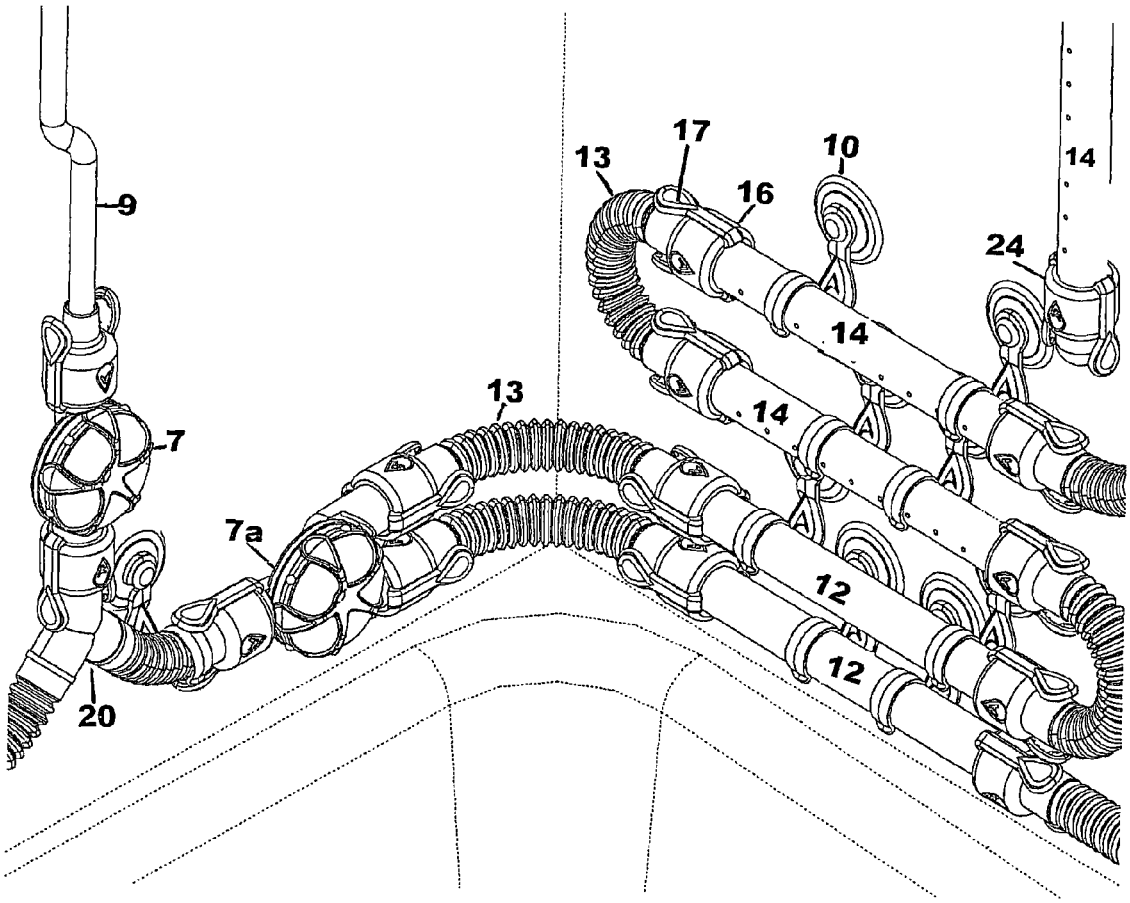
FIG. 7 is an exploded view of the downstream water delivery components (in one possible arrangement/configuration) showing the connection of semi-rigid pipes having male-male ends, with and without spray holes or functions, to other components of the system having female configured ends.
Figure 17:
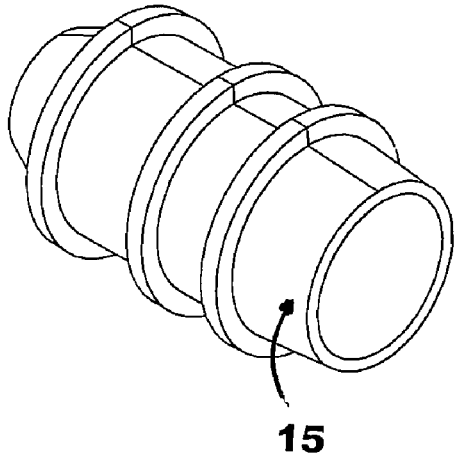
FIG. 17 is a view of the male configured ends used in semi-rigid pipes, the end sprayer's hose, the bath mat hose, and shower curtain connector, which enable the attachment and interoperation of these components with the rest of the system through connection with any female configured end of another of the water delivery components of the system.

Semi-rigid ((12) and FIG. 5) and flexible ((13) and FIG. 6) water conduits (channels), i.e., pipes, are the fundamental building blocks and water delivery components of the system. As FIGS. 1 and 7 show, these pipe components are used to connect together various educational, entertaining and/or functional components of the system and also serve as water conduits (channels). The semi-rigid pipe ((12) and FIG. 5 (*a*)) is designed to withstand the required pressures, temperatures and flow rates of the system. The semi-rigid pipes (12) are also designed to give and bend as an anti-impalement, safety measure. The semi-rigid pipe (12) uses male configuration features on both ends of the pipe. A general view of a male configured end is shown in FIG. 17.

The flexible pipe ((13) and FIG. 6) is equipped with an internal water flow hose and a female end configuration feature (female connector assembly) on both ends of the pipe. The novel female connector assembly (16) provides for ease in connecting and disconnecting with components that have male configured ends. The female connector assembly (16) also provides a water tight, washer-less seal between male/female connected components, as further described below. The flexible pipe (13) also utilizes a versatile bellows design to allow the pipe section to bend up to 180 degrees (FIG. 6), allowing the child/user to rotate the pipe in any orientation, thus providing for three-dimensional flexibility in the construction of the system.

A waterfall pipe ((14) and FIG. 5(*b*)) can be included in the system and is designed off the semi-rigid pipe ((12) and FIG. 5(*a*)) design. A hole or set of holes in any design/orientation can be included in a semi-rigid pipe to provide a "waterfall"-like or spraying feature.

Figure 14:
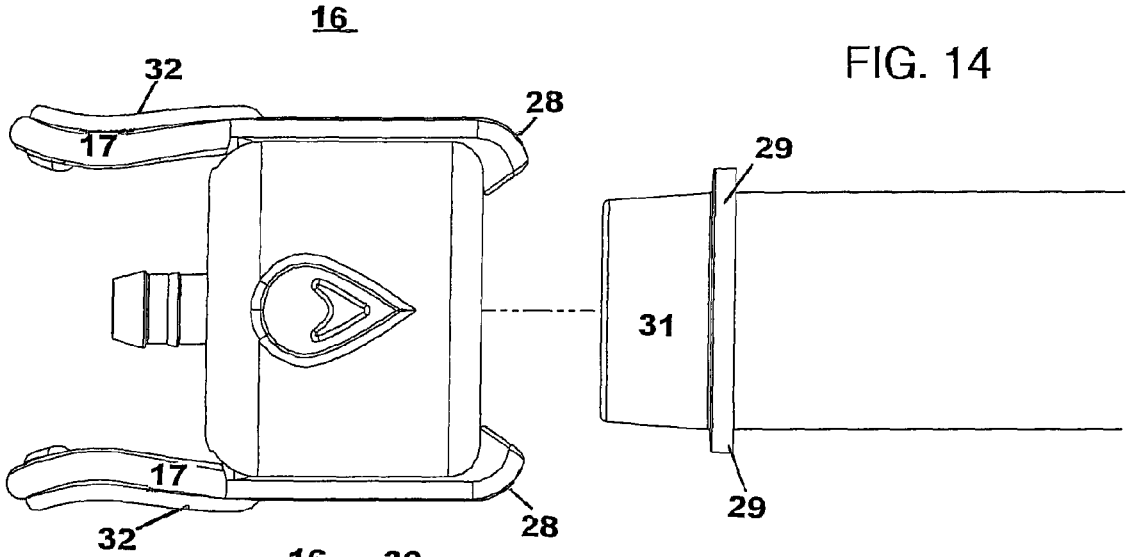
FIG. 14 is an illustration of the male-female connection features, which are used to connect various components of the system together.
Figure 15:
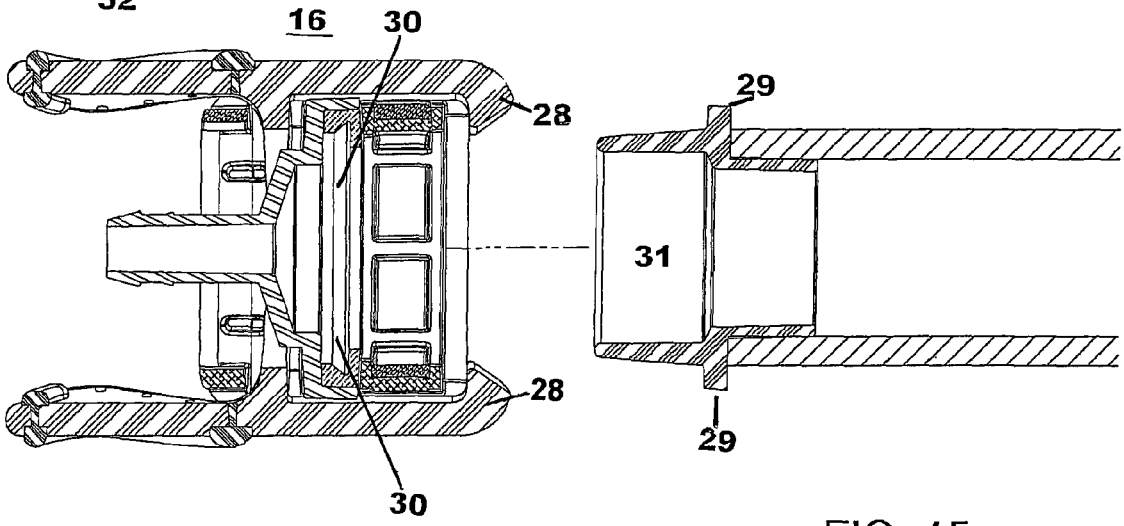
FIG. 15 is a cut-away illustration of the male-female connection components, showing their internal configuration and connecting parts.
Figure 28A:
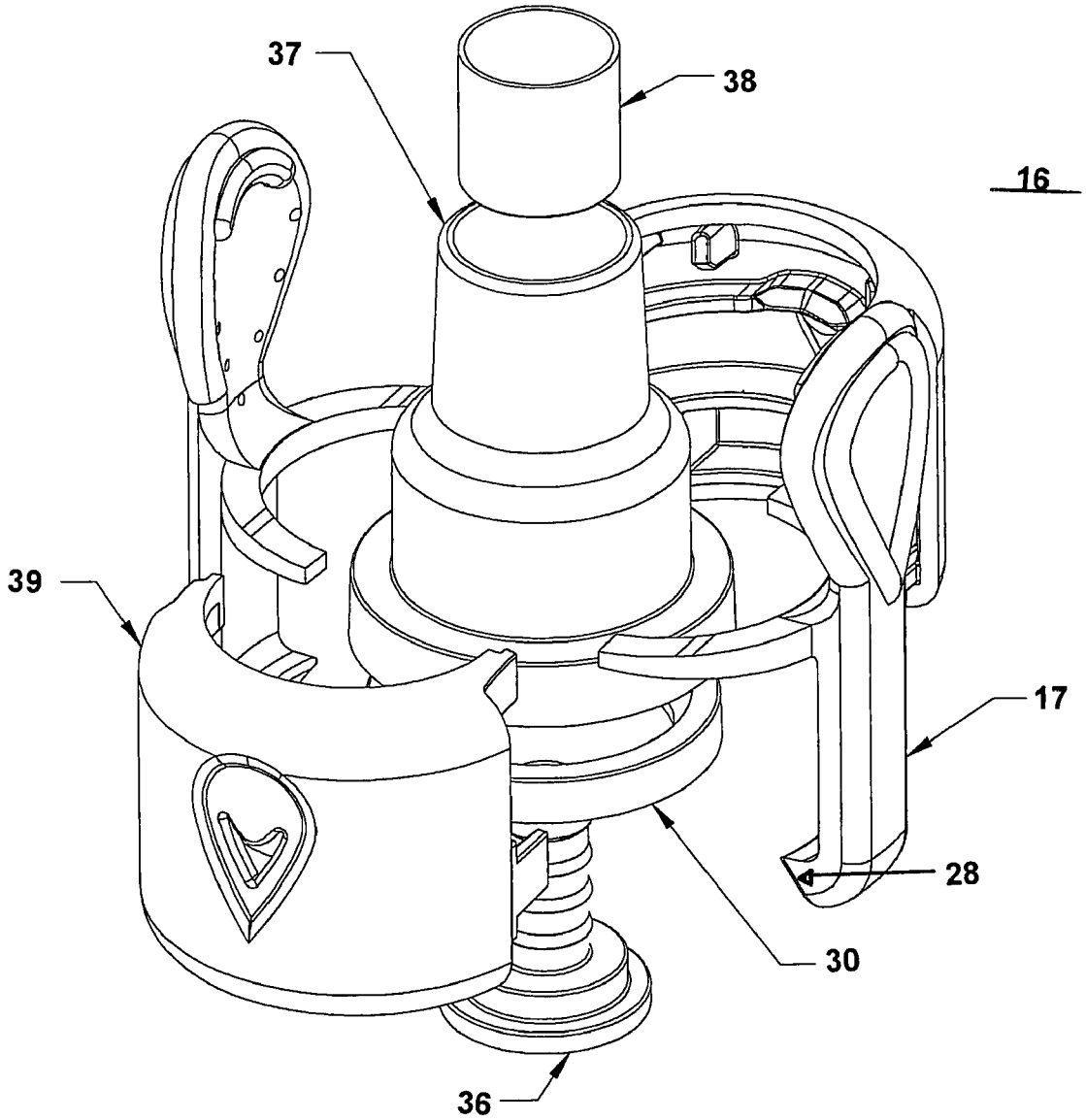
FIGS. 28(*a*) and (*b*) are exploded, break away views of different embodiments of the novel female connector assembly adapted for use and connection with other system components.
Figure 28B:
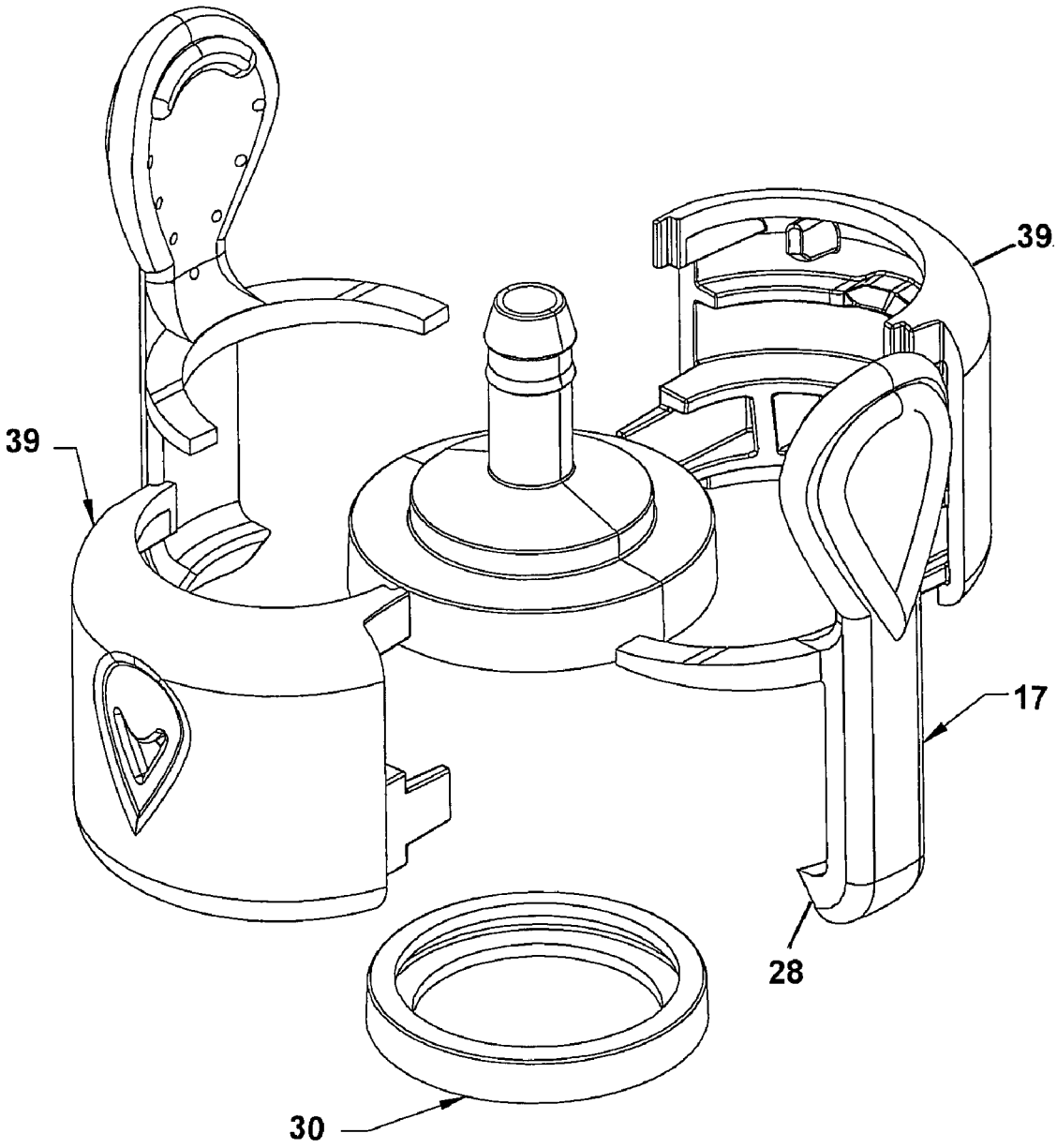

A unique feature of the invention is the male/female component connection design, utilizing the novel female connector assembly ((16) and FIG. 28), which limits the force required to connect and disconnect components having different configurations (male/female) and obviates the need for twisting, screwing, or other forceful efforts to achieve connection or disconnection of male/female components. The unique disconnection/connection feature works by pinching pre-tensioned levers (17) on the female connector assembly (16) to release the male configured end ((15) of FIGS. 5(*a*) and 5(*b*)); (31) of FIGS. 14 and 15) from its connection with the female configured end (16). Exploded views of a male configured end (31) and the female configured end (16) and their components are shown in FIGS. 14, 15 and 28(*a*) and (*b*).

It is imperative that the connection of male with female ends makes a water-tight seal; but at the same time, it is necessary that the connection design minimize the torque requirement to rotate male/female ends and to connect and disconnect male/female configured components in order to facilitate use by a younger or disabled user. The invention achieves a water-tight seal without the use of any washers, which would present safety issues for the underage users, through the use of a hard seal ((30) of FIGS. 15 and 28(*a*) and (*b*)) that is co-molded into the female connector assembly. The co-molded seal deforms and forms a water-tight connection when male configured ends ((15) of FIGS. 5(*a*) and 5(*b*)) and female connector assemblies (16) are joined together.

Figure 24:
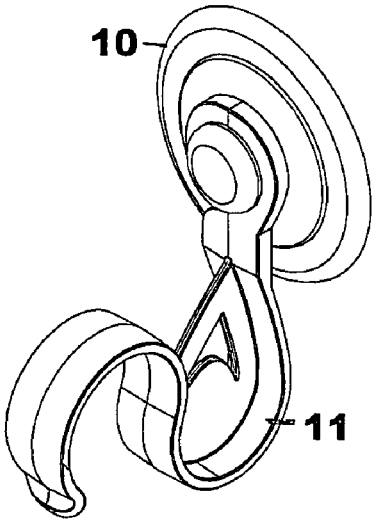
FIG. 24 is a view of the suction cup and bracket designed for use with most system components.
Figure 25:
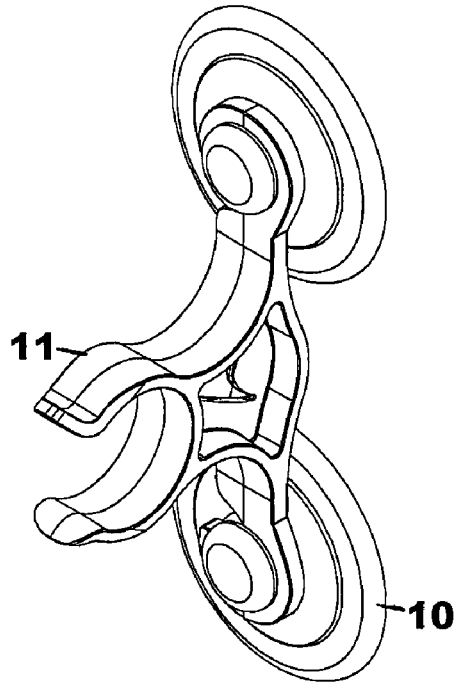
FIG. 25 is a view of suction cups and bracket designed for use at the point where the multi-function sprayer hose is connected to the system.
Figure 26:
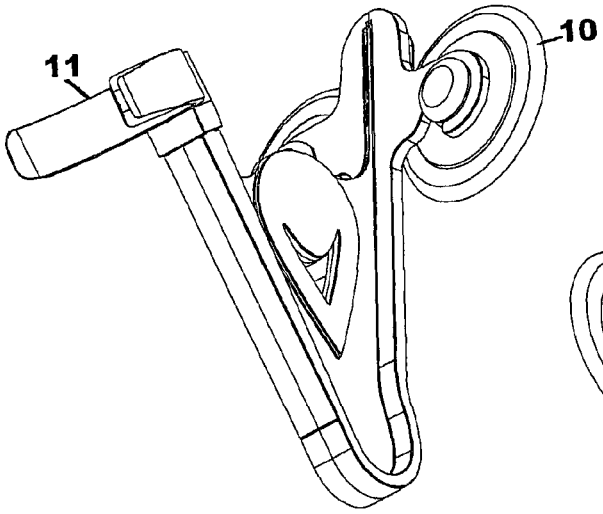
FIG. 26 is a view of the multi-function sprayer holder with suction cups and bracket oriented in an upward facing position.
Figure 27:
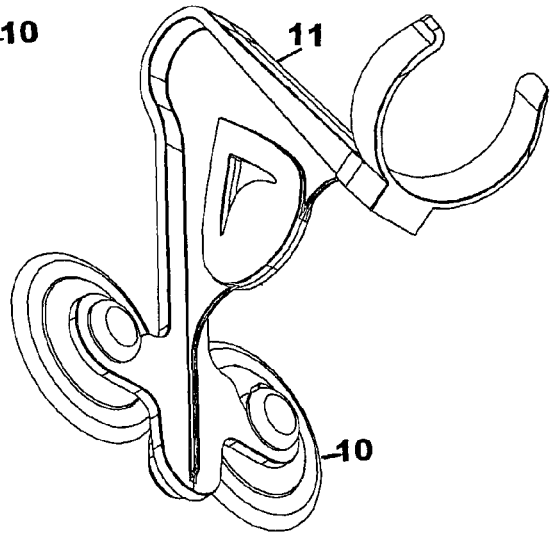
FIG. 27 is a view of the multi-function sprayer holder with suction cups and bracket oriented in a downward facing position.

A suction cup bracket (11) and suction cups (10) are used to mount all system components (except the main (parental) control valve which threads to a pre-existing shower water pipe stem) to the shower or bathroom wall. Each suction cup (10) and bracket (11) is designed to hold up to three pounds of weight and can be used anywhere on the standard pipe (semi-rigid or flexible), tubing, hoses or other system water delivery components. The brackets (11), in use, are principally in a vertical orientation to maintain their holding force. The bracket is also designed so that the user can pull the suction cup off the wall without damaging the bracket. The bracket, when deployed in a vertical orientation, is designed to reallocate uneven downward force on the suction cup, distributing the applied force in a more even manner on the suction cup, thus reducing suction cup failure rate. FIG. 24 illustrates one suction cup (10) and bracket (11) combination, and FIG. 25 illustrates yet another combination designed for use in areas where more support is needed. A specially designed suction cup and bracket for the multi-function end sprayer (19) is shown in FIGS. 26 and 27 in different (upward and downward facing) orientations.

Figure 8:
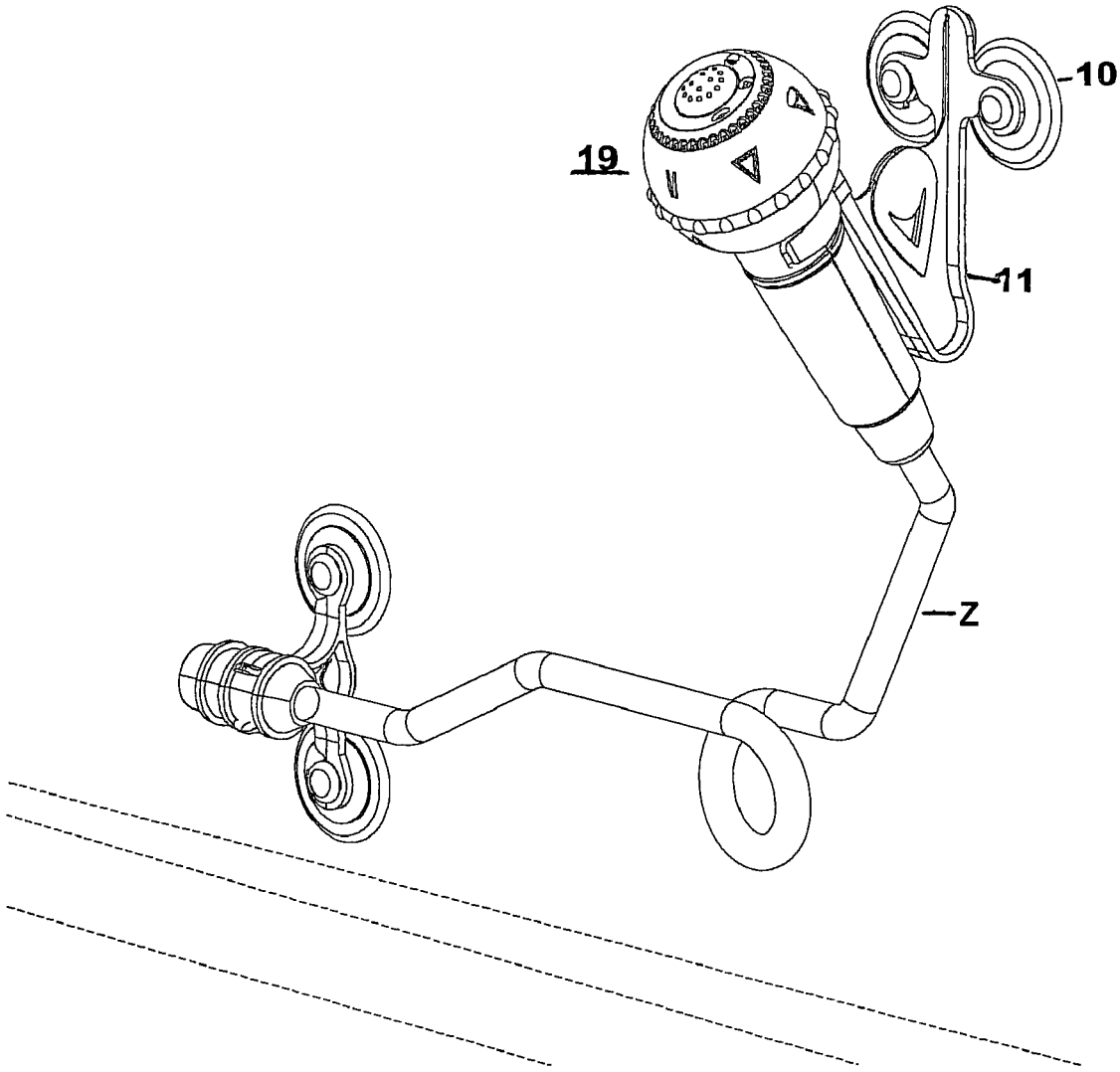
FIG. 8 is an exploded view of the multi-function sprayer in an upward facing position.
Figure 9:
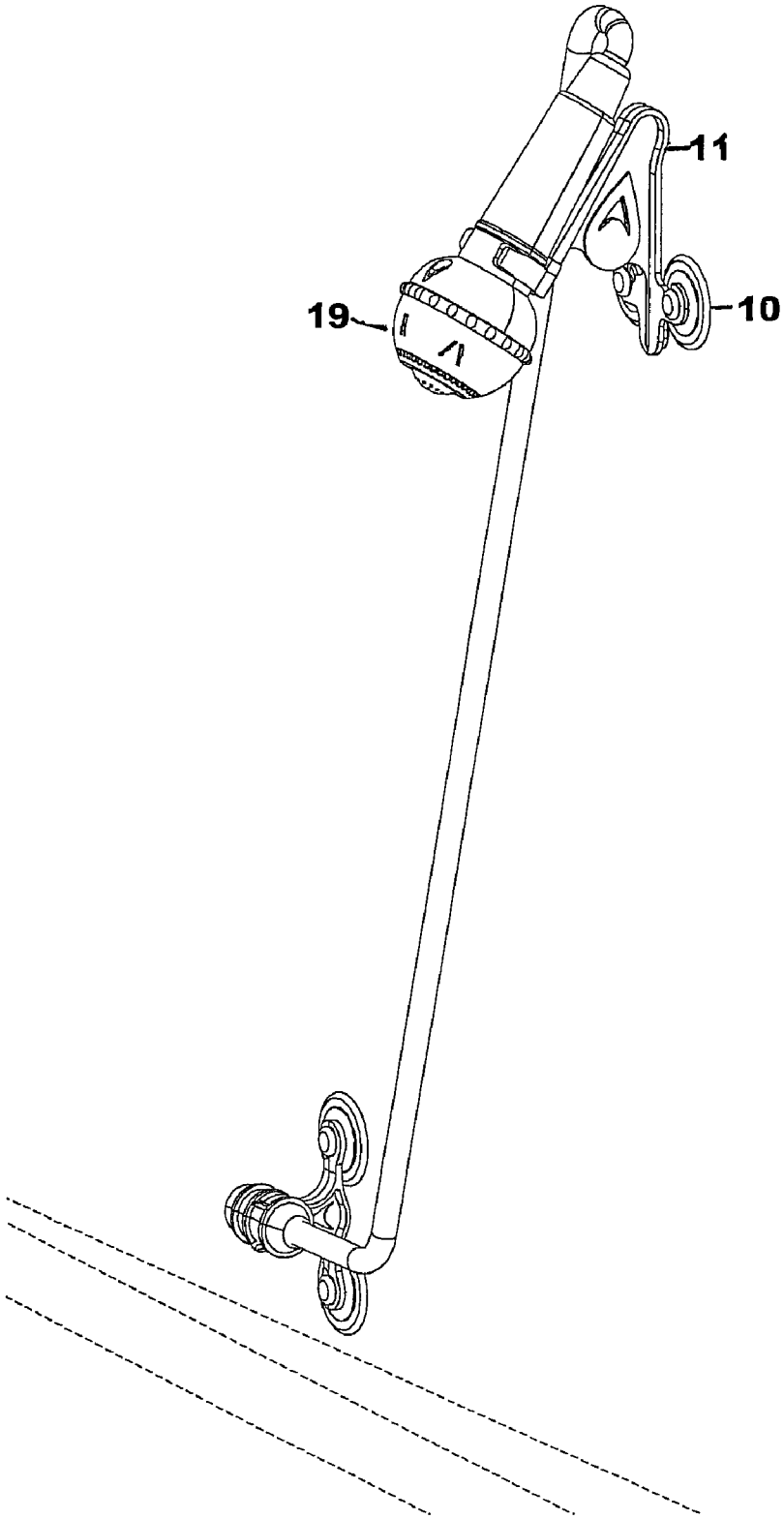
FIG. 9 is an exploded view of the multi-function sprayer in a downward facing position.
Figure 18:
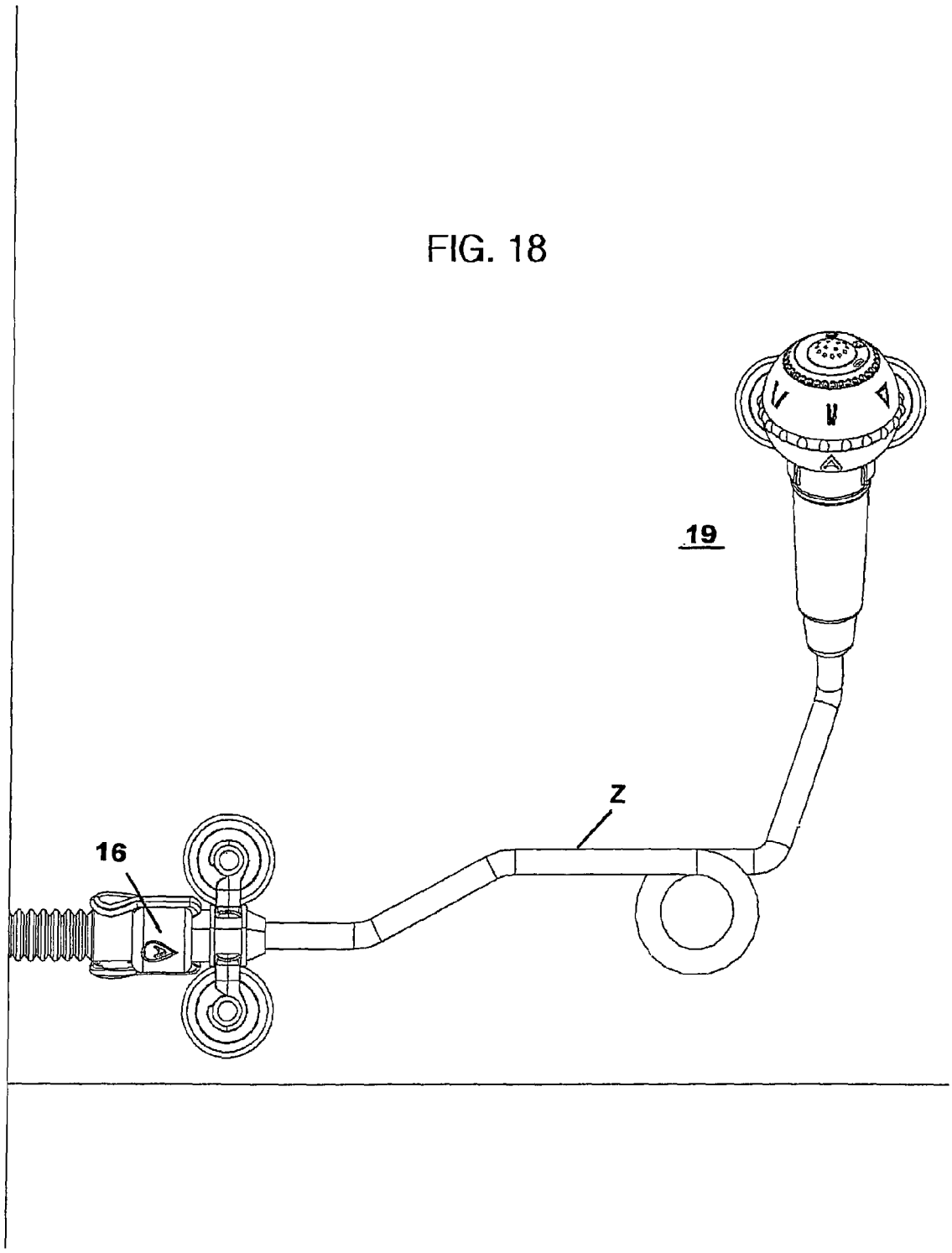
FIG. 18 shows the male configured end of the end sprayer's hose, which connects the multi-function sprayer component with a section of flexible hose that has a female configured end.

As shown in FIGS. 1, 8 and 9, the multi-functional end sprayer (19) is another entertaining and functional component of the water toy construction system. The end sprayer is mounted at the end of the system and allows the child/user to select from multiple different spray features, including a stop feature. The end sprayer is designed to child/user ergonomics standards, accommodates those having disabilities, and provides a safe, fun spraying/showering tool. The end sprayer includes a mounting bracket with suction cups, which allow the child/user to mount it on the side of the shower wall in either an upward (FIGS. 8 and 26) or downward (FIGS. 9 and 27) orientation, while it continues to spray water. The mounting bracket thus enables the end sprayer to be used in applications of significance to those with disabilities, who require showering in a seated position. The mounting bracket design for the end sprayer is also angled to allow water to spray outward onto the child/user. The end sprayer also comprises a short flexible hose attached directly to the sprayer as shown in FIG. 18 (Z). The hose connects to a flexible pipe component of the system using a female connector/adapter (16). A specialized suction cup bracket (FIG. 25) is used to secure the weight of the system at the intersection/connection of the end sprayer hose (Z) with the flexible pipe component as illustrated in FIGS. 18 and 25.

Figure 29A:
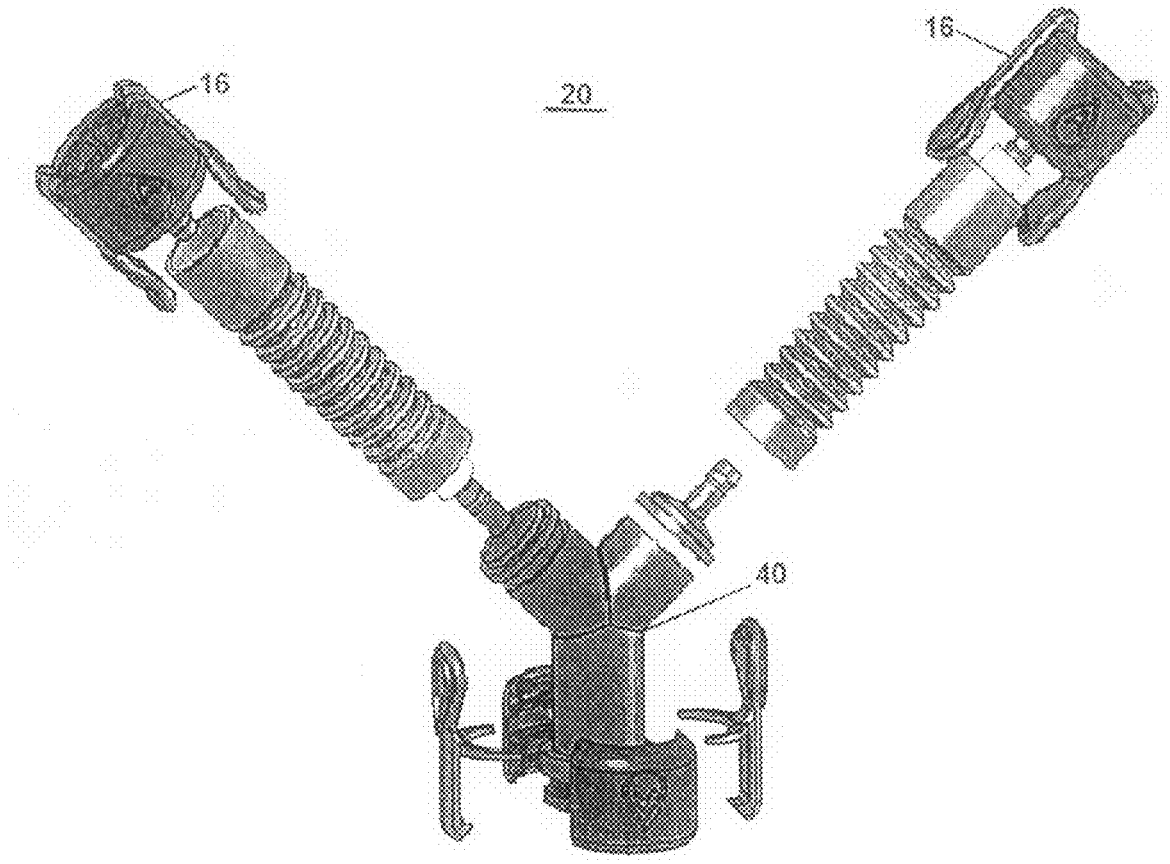
FIG. 29(*a*) is an exploded, break away view of the "Y" connector showing the three specially adapted female connectors, flexible pipe and rigid "Y" assembly.
Figure 29B:
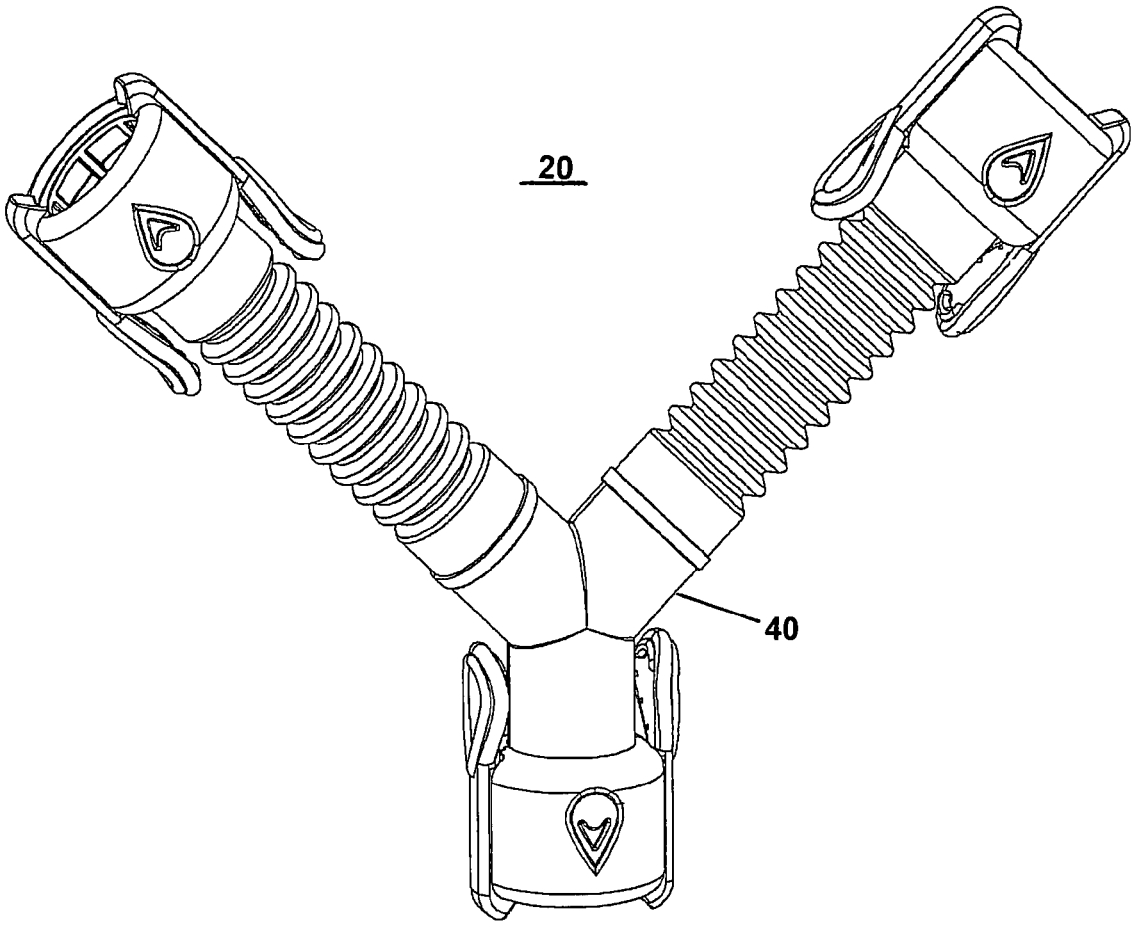

A "Y" connector assembly ((20) of FIGS. 1, 4, 7 and 29(*a*) and (*b*)) is a specially designed and constructed component used to facilitate multiple paths or routing of water delivery through various system components and to divert water to two different, separately constructed sections or different components of the system. This component allows the child/user to connect multiple components to the system and/or to channel water into different, separately constructed sections or components of the system. For example, the "Y " connector assembly component may be connected to the end sprayer on one water outlet end and a waterfall pipe on the other water outlet end. It may also be used to divert water flow into a shower curtain or bath mat, while still maintaining water flow to other system water delivery components. The "Y" connector assembly (20) comprises a rigid "Y" center piece ((40) of FIGS. 29(*a*) and (*b*)) with two flexible pipes connected to two prongs of the rigid "Y" center piece. The flexible pipes allow for mounting in any orientation. Water flow enters the "Y" connector assembly (20) on one end and exits through one or both of the flexible pipes, thus allowing for water delivery in two different directions. FIG. 29 (*a*) shows a break away view of the unique construction of the "Y" connector assembly, and FIG. 29(*b*) shows a finished assembled view of the "Y" connector assembly. The flexible pipes connect to other system components through female connector assemblies.

The floor (bath) mat component (FIGS. 10, 11 and 12) provides a platform for the user. The floor (bath) mat mounts to the bottom of the shower or bathtub (floor) and connects to any system component having a female connector assembly (female configured end). The floor mat is not required for the operation, function or enjoyment of the system. The floor mat may include a "Y" connector or a flexible pipe component in order to connect the mat into the system. Water diverts from the system into the mat and sprays up on the child/user. The bath mat may also be mounted to the shower/bath wall and be used to spray water out at the child/user. Various artistic designs can be included on the top surface of the floor mat, including, but not limited to, a surf board design. The system floor mat can take the place of a standard bathtub mat. Co-molded suction cups may be used to fix the mat to the floor of the shower/bath unit, or to the walls, as desired.

The shower curtain (FIG. 13) provides another spraying function/feature of the system. The shower curtain may replace an existing shower curtain and connects to any system component having a female configured end (female connector assembly). The shower curtain is a separate component and may include a "Y" connector assembly (20) as described above or flexible pipe, in order to connect the curtain into the system. Water may be diverted from the system into the curtain and will spray onto the child/user. Various artistic designs can be included on the inside and outside surfaces of the curtain, including but not limited to a tube wave, a tropical forest, a coral reef, other depictions of flora and fauna, a fire fighter scene, an inside-the-human-body scene, and other entertaining and educational artwork. The spray patterns and water channels on the shower curtain can be altered to relate to or enhance the artwork on the shower curtain. The shower curtain may be detached from the system and can serve as the conventional, household shower curtain. There is no need for two shower curtains.

Figure 16:
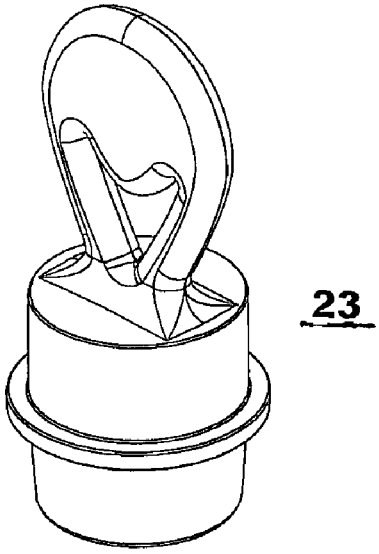
FIG. 16 is an illustration of a male end cap used to cap a water conduit or other water delivery component that has a female configured end.
Figure 19:
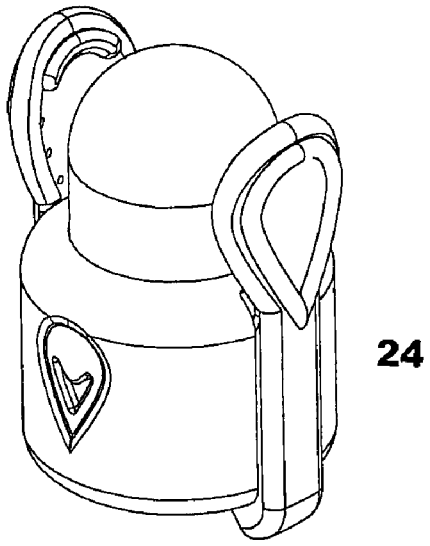
FIG. 19 is a view of a female configured end cap, which is used to cap a water conduit or other water delivery component that has a male configured end.
Figure 20:
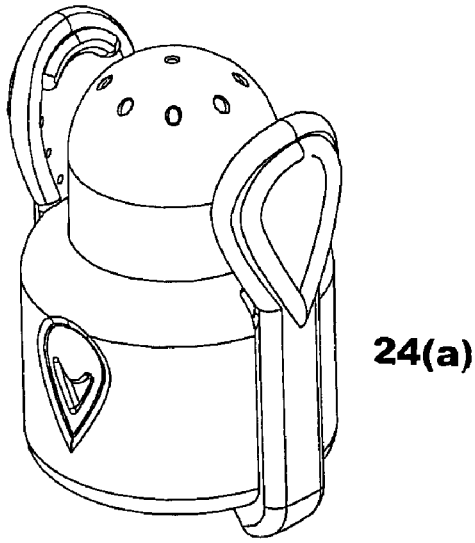
FIG. 20 is a view of a spraying female configured end cap, which adds a spraying function to the end of a water conduit or other component.

The inventive system also includes male (23) and female (24) end caps and a female end cap with spraying functionality (24(*a*)) as illustrated in FIGS. 16, 19 and 20, respectively. These end caps allow the user to stop the water flow at the end of any water delivery conduit, channel or component included in the system. The female end cap with spraying functionality (FIG. 20) is in every respect identical to the female end cap (FIG. 19), except that it has one or more holes in it to allow the cap to be used as an additional sprayer or means of water delivery.

FIG. 2 further illustrates the connection and interoperation of the main (parental) control valve and the existing shower head. The parental control valve (4) is screwed onto the existing pipe stem (3 and 3(*a*) of FIG. 2). A shower head can then be screwed onto the parental control valve's threaded shower head portal (25). A drop down high pressure hose (8) is connected to the system's water inlet portal (26) on the proximal (to the pipe stem) side of the main (parental) control valve (4). A push-pull plunger (selector) (5 and 5(*a*)) at the top and bottom of the parental control valve are used to alternate water flow from the existing pipe stem (3) to either the shower head portal (25) or the water toy construction system portal (26). A permanently attached sliding hose and pipe stem clip (27) is connected to the drop down hose (8). This clip enables users to keep the hose out of the way of shower caddies and other household or bathroom items suspended from the pipe stem. The parental control valve has a unique, substantially vertical design, which is intended to minimize the downward extension of the showerhead into the showering area. The push-pull design of the plunger (selector) (5) is designed to give both short and tall parents an easy and accessible means of reaching and operating the parental control valve and to allow users to optimize their leverage on the valve.

FIG. 3 further illustrates the connection and relationship of the main (parental) control valve (4) and the existing shower head (not shown) from below. As stated above, the parental control valve has a substantially vertical design to minimize the downward extension of the showerhead into the showering area, when the showerhead is attached to the shower head portal (25).

Figure 4:
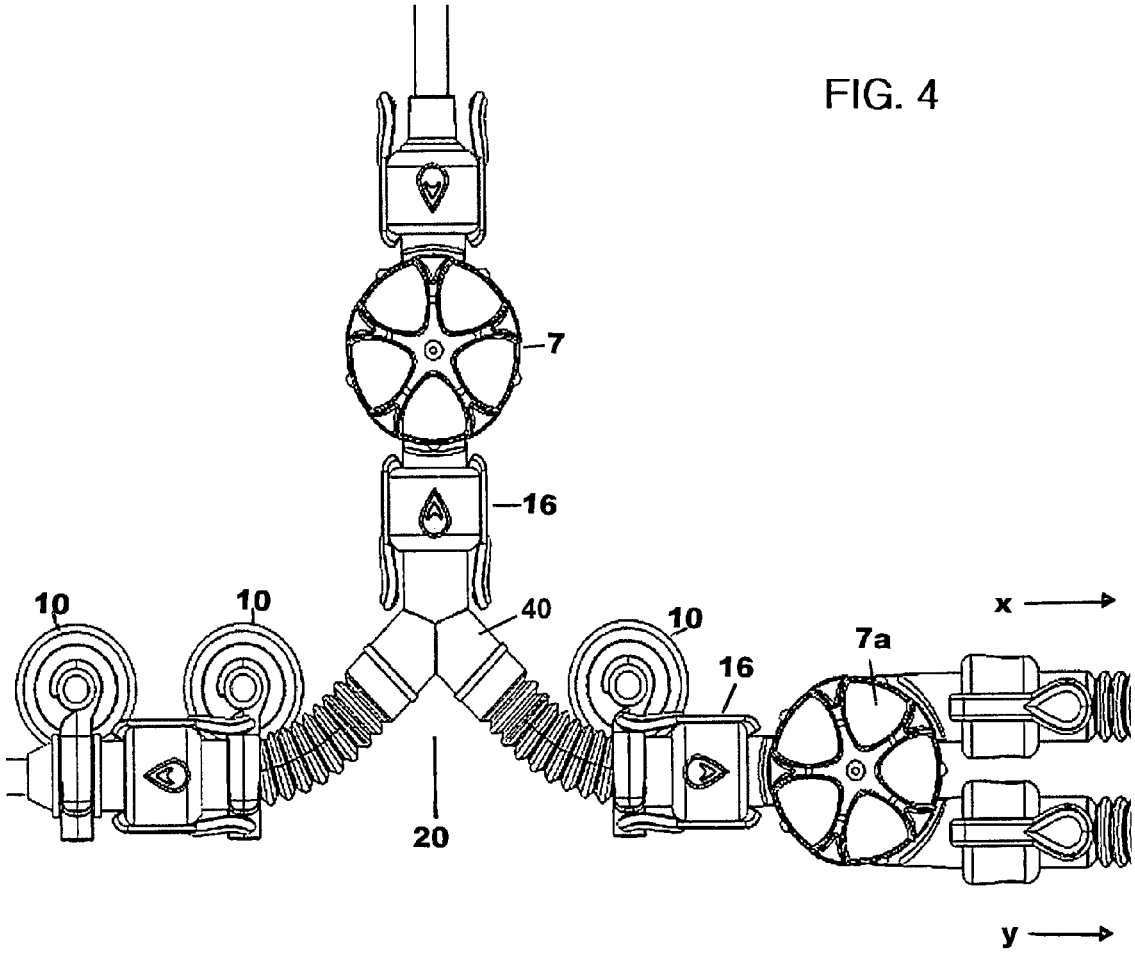
FIG. 4 is an exploded view of one arrangement for a user shutoff (on/off) control valve, flexible "Y" coupling, user flow diverter valve, and suction cups maintaining and supporting the system.

FIG. 4 further illustrates one embodiment of the connection and interoperation of the system's user shutoff (on/off) valve (7), a flexible "Y" connector assembly (coupling) (20), and in-line user diverter valve (7*a*), and suction cups and brackets (10, 11) supporting and mounting the system components to the shower/bath wall. Water flow lines designated "x" and "y" illustrate the directionality of the two outlets to which water flow may be allocated. The valves are added into the system in a manner such that the water flow is directed downstream to other water delivery components.

FIGS. 5(*a*), 5(*b*) and 6 further illustrate the invention's water delivery conduits showing semi-rigid (12) and spraying "waterfall" pipes (14) and flexible pipes (13). The semi-rigid pipes have male/male end configurations. As an anti-impalement safety measure, the semi-rigid pipes may be made of plastics or resins that collapse or deform when pressed against the body. FIG. 6 illustrates the flexible pipe water delivery conduit with female connector assemblies (16) on both ends. The flexible pipe allows for various orientations/configurations of the components within the system, as discussed above.

FIG. 7 further illustrates an exploded view of one arrangement of for certain system components connected in various orientations to operate and provide a distinctive and entertaining showering experience. The arrangement of components is not fixed, and the figures showing various arrangements are not intended to limit the range of possibilities for connecting water delivery components. Water delivery components may be added to or removed from the system in any order (below the pressure regulator) that is consistent with their respective end configurations (male/female) and that maintains the direction flow of water downstream to other water delivery components.

FIGS. 8 and 9 further illustrate the spray head (19), suction cups (10) and bracket (11) mounted in the upward and downward facing positions. FIGS. 26 and 27 show the specialized end sprayer brackets in isolation, one facing upward and the other facing downward. The brackets are designed to reallocate downward force on the suction cups, redistributing the force as more of an even outward force rather than downward, thus making the suction cups less likely to fail due to uneven downward forces.

Figure 10:
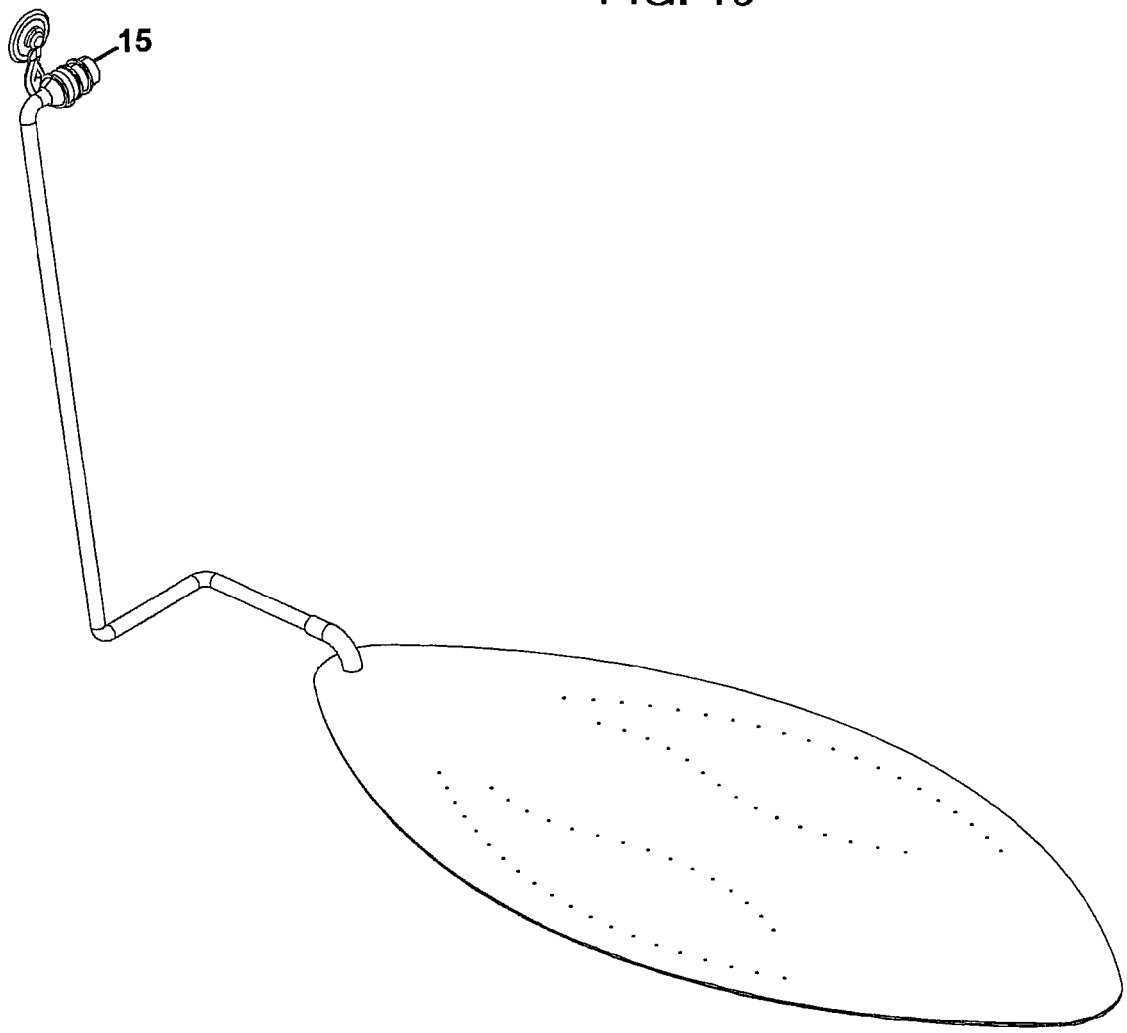
FIG. 10 is a view of a bath tub mat adapted for integration into the water toy construction system, showing connector (male configured end) and one configuration of water flow and outlets.
Figure 11:
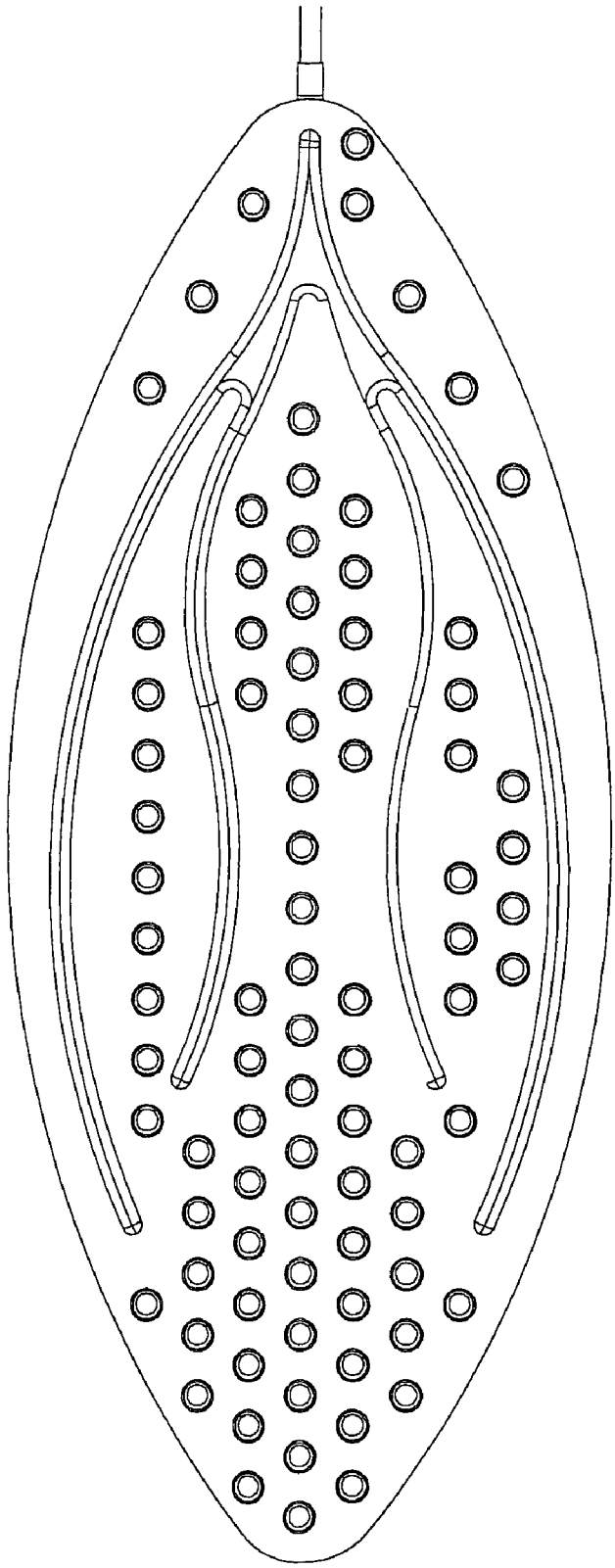
FIG. 11 is a bottom view of a bath tub mat adapted for integration into the system, showing one configuration of water flow.
Figure 12:
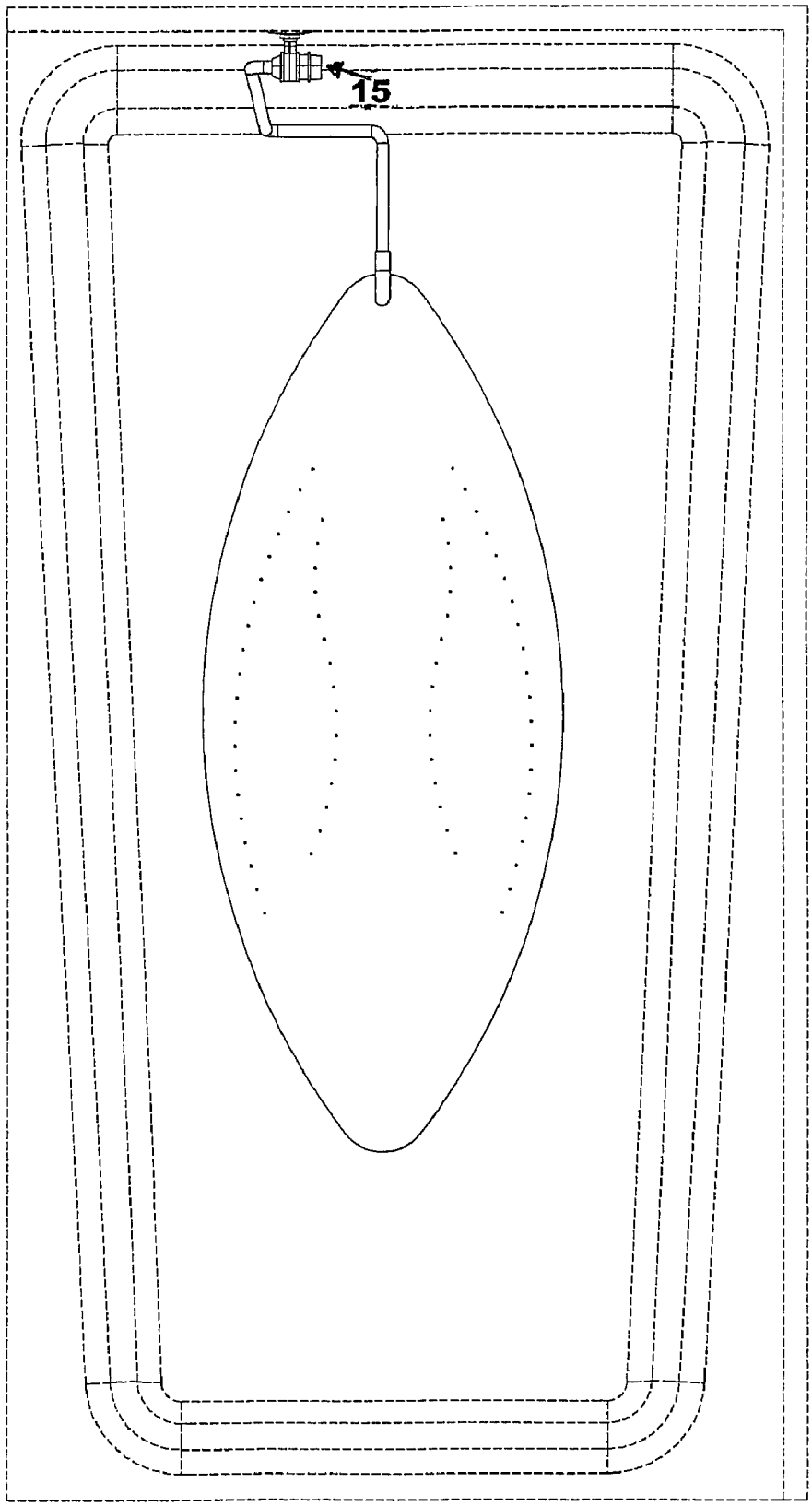
FIG. 12 is an overhead view of a bath tub mat adapted for integration into the system, showing the connector (male configured end) to the system and one configuration of water flow and outlets.

FIGS. 10, 11 and 12 further illustrate a view of a bath tub mat for use with the inventive shower water construction system, showing connectors and configuration of water flow and outlets. The bath mat may or may not be equipped with suction cups, depending on whether it is intended to be mounted upon the wall, although suction cups may be used as an added safety feature when the mat is used on the floor of the shower/bath unit. The spray patterns on the mat may be varied to conform with specific artwork on the mat or the shape of the mat. The illustration of the mat in the figures is not intended to be restrictive, and it is fully expected that mats having various shapes and sizes, as well as colors and designs, can be used with the system.

Figure 13:
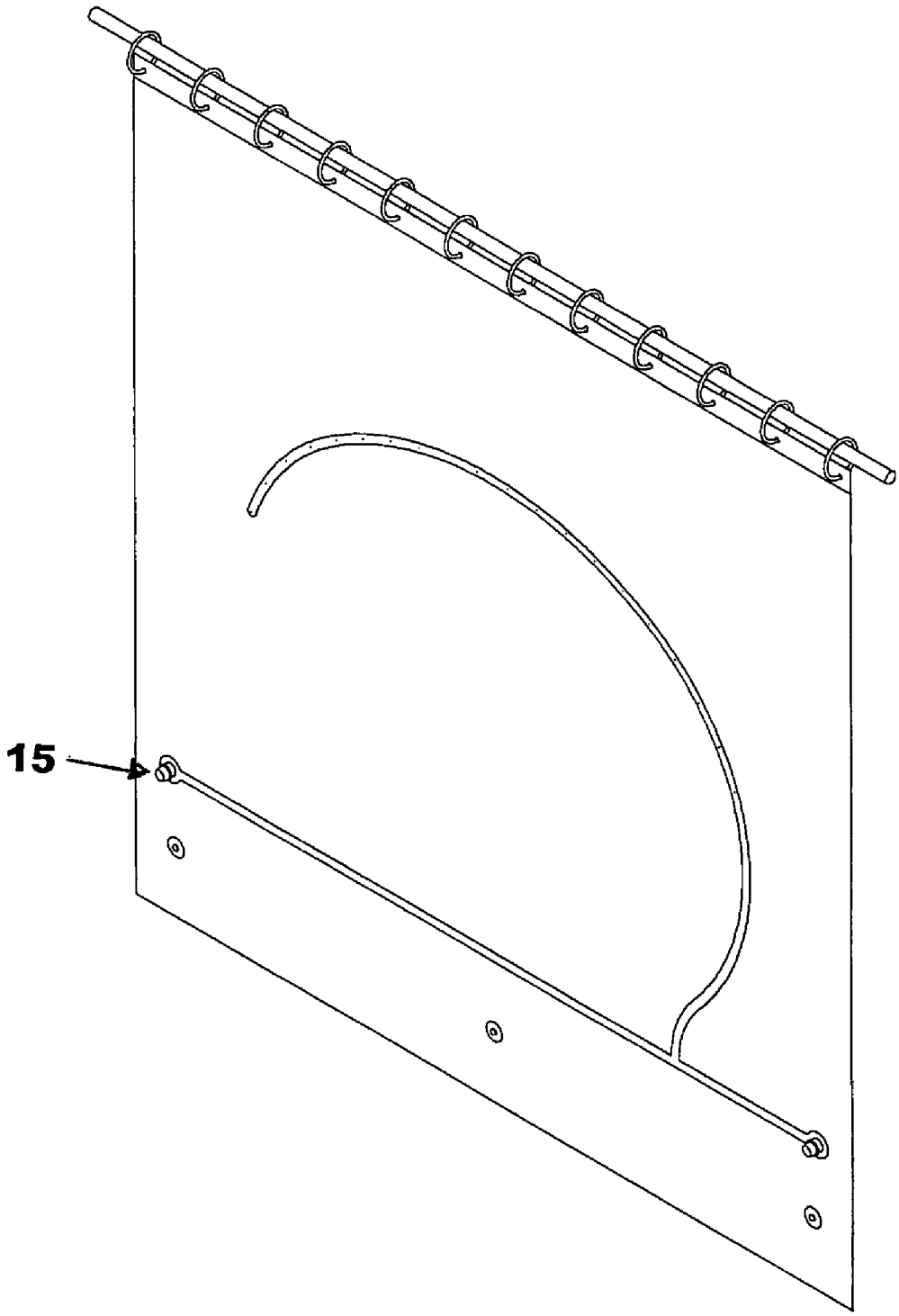
FIG. 13 is an inside the bathtub view of a shower curtain for connection to the system, showing the connector (male configured end) to the system and one configuration of water flow and outlets.

FIG. 13 further illustrates an inside the shower or bath view of a shower curtain for connection into the system, showing one embodiment of a configuration of water flow and connectors. The spray pattern on the shower curtain may be altered to match the artwork or design printed on the curtain. The dimensions of the shower curtain may be altered to accommodate different size showering spaces or environments.

FIGS. 14 and 15 further illustrate exploded views of the male/female connection feature used to connect various components of the system. This novel connection feature provides a low insertion force, pinch release, no twist, no screw, water tight, washer-less seal, enabling the connection/disconnection of components to be easily and safely accomplished by a child in a wet environment, or by those with disabilities. The connection does not depend for its sealing function on friction between the male and female configured ends, nor does it depend on any screwing or twisting action or functionality in order to achieve a connection. The connection depends instead on two or more pre-tensioned levers (17) with overbite grips (28) on the female end of the connection, which grips are designed to catch the raised lip (29) of the male configured end of the connection so as to retain the male end in the "grip" of the female configured end. When water pressure creates forces that might otherwise pull the connection apart, the pretension levers (17) with overbite grips (28) hold the male end in union with the female end by gripping the raised lip or ridge of the male end (29). To ensure that this connection/union is also water tight, a hard seal (30) has been co-molded near the base of the receiving portion of the female end. This co-molded seal (30), which is sized to fit snugly around the tapered head of the male end (31), is designed to close and seal the gap between the tapered head of the male end and the receiving portion of the female end. By using a co-molded seal design, the safety hazards of using a loose washer arrangement (e.g., choking hazards) are avoided without compromising the ability to achieve a watertight seal at each male-female connection/union in the system. To release the male end from the female end, light pinching force is applied to finger tabs (32) at the rear of the pre-tensioned levers (17), thereby opening the overbite grips (28) and released the raised lip (29) of the male end of the connection, thus undoing the connection.

FIGS. 16, 19 and 20 illustrate, respectively, the male end cap (23), the female end cap (24), and the female spraying end cap (24(*a*)). These caps allow a user to stop water flow in a given system water channel using the male/female connection described above. The spraying female end cap adds an additional spraying function at the end of a given water system channel or component.

Figure 21:
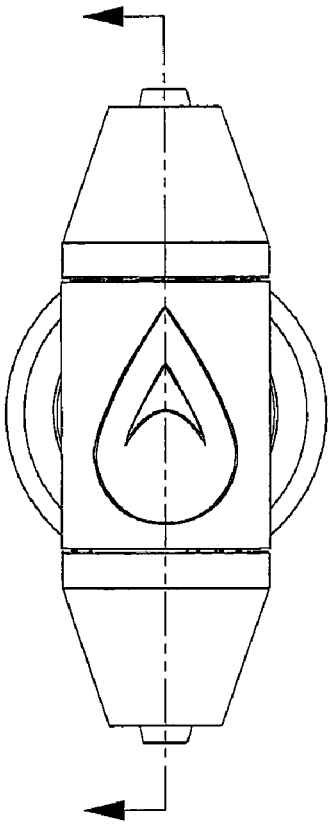
FIG. 21 is an exploded view of the in-line pressure regulator located on the high pressure system drop hose that connects to the parental control valve.
Figure 22:
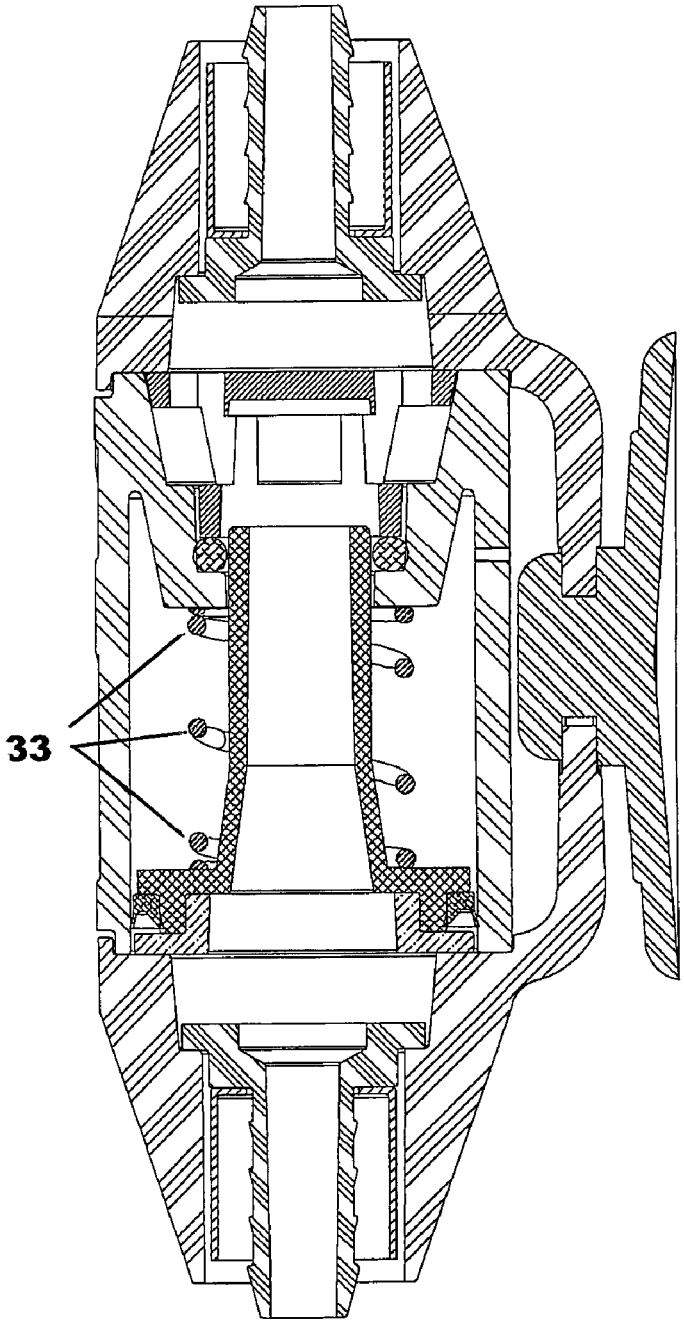
FIG. 22 is an exploded cut-away view of the in-line pressure regulator showing internal parts and configuration.
Figure 23:
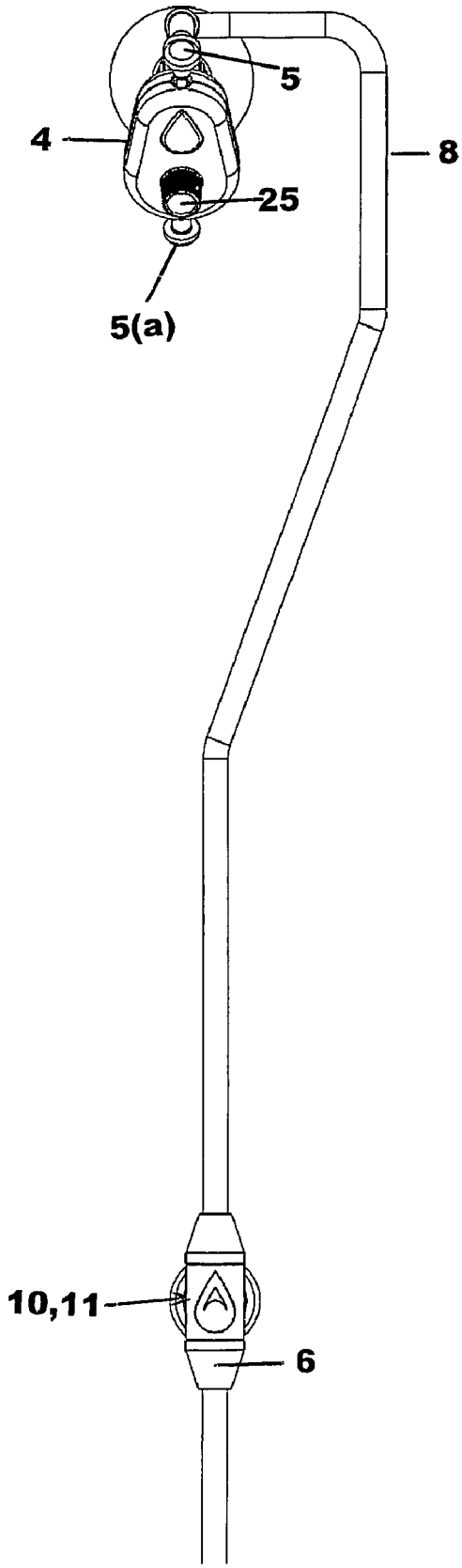
FIG. 23 shows the placement of the in-line pressure regulator on the high pressure drop down hose, below the main (parental) control valve.

FIGS. 21 and 22 further illustrate an assembled and cutaway view of the in-line pressure regulator (6) that regulates total water pressure in the system. The regulator is spring-activated (33) and acts as an on-off switch, allowing all water to pass through to the rest of the system so long as the pressure in the system does not exceed about 35 psi. If this tolerance is exceeded, the spring-activated pressure regulator (6) closes off water flow to the system. FIG. 23 shows the connection of the pressure regulator (6) and its high pressure (drop down) hose (8) to the main (parental) control valve (4). Above the regulator, water pressures may exceed 135 psi. Beneath the regulator, the regulator works to keep water pressure in the system below about 35 psi.

FIGS. 24, 25, 26 and 27 further illustrate the various suction cups and brackets used to mount system components and to support and hold the weight of the system and it various components, plus water, against the surface of the shower/bath enclosure walls.

FIG. 28(*a*) illustrates an exploded, break away view of one embodiment of the novel female connector assembly of the invention that is used in connection with the pressure regulator hose. FIG. 28(*a*) also shows a barbed fitting (36) for use within the female connector assembly and designed for use with flexible pipe. A female tube adapter (37) and hose ferrule (38) for attachment to the pressure regulator hose or flexible pipe internal hose are also shown, along with the co-molded seal (30) placement. FIG. 28(*b*) illustrates an exploded, break away view of another embodiment of the novel female connector assembly. The entire female connector assembly is enclosed or surrounded by a molded cover (39), which also comprises the pre-tensioned levers (17) and grips (28) for attaching to a male configured end.

FIG. 29(*a*) is an illustration of an exploded, break away view of a "Y" connector assembly (coupling) showing flexible pipes attached to two prongs of a rigid "Y" piece (40) through a bonding method. The flexible pipes' inner core tubes are clamped onto barbed fittings ((36) of FIG. 28(*a*)). The barbed fittings are spun welded to the rigid "Y" piece (40). All three connecting "ends" of the "Y" connector assembly have a female connector assembly (female configurations). FIG. 29(*b*) shows a finished assembled "Y" connector assembly (coupling).

The invention does not imply longer shower times with the water running needlessly. Indeed, the invention invites the child/user to spend time in the shower with the water turned off (either at the existing water source or at the user shutoff valve), while rearranging the system components on the wall and connecting them to each other. Moreover, the 2.5 gpm flow restriction further aids in reducing water waste. Whether or not a water savings will be achieved using this invention will be determined as a matter of personal choice.

In accordance with the patent statutes, the best mode and preferred embodiment have been set forth; the scope of the invention is not limited thereto, but rather by the scope of the attached claims.

What is claimed is:

1. A shower water toy construction system for use in a pre-existing indoor shower/bath unit comprising:

a. a main control valve connected directly to an existing pressure-driven shower water supply pipe and having two diverting portals for directing water either to a standard shower head or to a high pressure hose of the system, but not both, wherein the main control valve limits water flow to either portal to about 2.5 gallons per minute and wherein the high pressure hose is capable of withstanding water pressures of up to about 125-135 psi;

b. a spring-loaded in-line pressure regulator, connected proximally to the main control valve through the high pressure hose and distally to the system's downstream water delivery toy components through another water supply hose, that allows water flow to the system's downstream water delivery toy components and limits pressure on said components to about 35 psi without the need for manual intervention, and that automatically shuts off water flow to said components when the 35 psi pressure is exceeded; and c. a plurality of downstream water delivery toy components operatively connected to the water supply hose and each other, selected from the group consisting of a "Y" connector assembly, manual user shutoff valves, manual user diverter valves, semi-rigid pipes, flexible pipes, hoses, a spraying bath mat, a spraying shower curtain, a spraying pipe, a spraying end cap, a multi-function sprayer and combinations thereof, wherein the semi-rigid pipes have male connecting configurations on both ends and wherein the flexible pipes have female connecting configurations on both ends, wherein the female configured ends of the flexible pipes further comprise a female connector assembly having pre-tensioned levers for easy connection and disconnection to male configured ends, overbite grips for grasping male configured ends, and a co-molded seal to provide a washerless, water-tight seal between male configured ends and female configured component ends when joined.

2. A shower water toy construction system as set forth in claim 1, wherein the downstream "Y" connector assembly, shutoff valves and diverter valves permit diversion of water flow to two separately constructed sections of the downstream water delivery toy components or to two different water delivery toy components.

3. A shower water toy construction system as set forth in claim 1, having a mounting assembly for the system's water delivery toy components, said mounting assembly further comprising suction cups and suction cup brackets for mounting the system's water delivery toy components to a shower or bathroom wall, and having a weight bearing capacity of up to three pounds of weight.

4. A shower water toy construction system as set forth in claim 3, wherein the suction cup bracket has a vertical configuration to maintain its holding force on the water delivery toy components, by reallocating uneven downward applied force by a user on the mounting assembly and distributing the applied force in a more even manner on the assembly, thus reducing suction cup failure rate.

* * * * *